US007064532B1

(12) United States Patent
Suzuki

(10) Patent No.: US 7,064,532 B1
(45) Date of Patent: Jun. 20, 2006

(54) VOLTAGE REGULATOR

(75) Inventor: Toshio Suzuki, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/285,141

(22) Filed: Nov. 23, 2005

(30) Foreign Application Priority Data

Nov. 26, 2004 (JP) ..... 2004-343012

(51) Int. Cl.
*G05F 1/40* (2006.01)

(52) U.S. Cl. ..... 323/276

(58) Field of Classification Search ..... 323/273, 323/274, 275, 276, 277, 279, 280, 282; 361/18, 361/93.9

See application file for complete search history.

(56) References Cited

U.S. PATENT DOCUMENTS 4,661,879 A * 4/1987 Sato et al. ..... 361/58
6,411,483 B1 * 6/2002 Sarles et al. ..... 361/93.4
6,465,993 B1 * 10/2002 Clarkin et al. ..... 323/272

FOREIGN PATENT DOCUMENTS

JP 63-078208 4/1988
JP 2002-091579 3/2002
JP 2003-285697 10/2003

* cited by examiner

*Primary Examiner*—Adolf Berhane
(74) *Attorney, Agent, or Firm*—Rader, Fishman & Grauer PLLC; Ronald P. Kananen

(57) ABSTRACT

In a voltage regulator according to an embodiment of the present invention, a delay circuit delays an enable signal by a delay time or less, the delay time corresponding to a certain time from a start of charging of the output capacitor to a completion of the charging of the output capacitor, and sends the delayed enable signal as a delayed signal to a mode selector. An overcurrent protection circuit unit operates according to a constant current type drooping characteristic from a time point of input of the enable signal. The overcurrent protection circuit unit operates according to a current limiting characteristic that can lower an output current below an upper limit value after a time point of input of the delayed signal. Thereby the output current having the upper limit value is prevented from continuing to flow after a time point of completion of charging of the output capacitor at the latest. The voltage regulator according to the embodiment of the present invention can protect the regulator itself and a load without lengthening a starting time.

4 Claims, 18 Drawing Sheets

31
Tout30
L30
C30
GND
GND
GND
Z31
Z32
P3
Z3
Vz30
Q25
Q20
Im1
Q21
Q22
Q23
Im3
N2
Q24
Iof1
Im2
34
33
Iof2
SW2
Q26
Vb2
S3
Vb1
DELAY CIRCUIT UNIT
32
S2
SC1
Ia
SW1
Q15
N1
Q11
Q16
Q17
Q14
Q10
Q12
Q13
A30
Tin30
Vin
Vref30
Vss
30

VOLTAGE REGULATOR

CROSS REFERENCES TO RELATED APPLICATIONS

The present invention contains subject matter related to Japanese Patent Application JP 2004-343012 filed with the Japanese Patent Office on Nov. 26, 2004, the entire contents of which being incorporated herein by reference.

BACKGROUND OF THE INVENTION

The present invention relates to a voltage regulator, and is suitable for application to a voltage regulator that is provided in a portable device such as a portable telephone or a PDA (Personal Digital Assistant), for example, and which has a protection function for preventing an output current from becoming an overcurrent (this function will hereinafter be referred to as an overcurrent protection function).

As shown in FIG. 16, in a typical voltage regulator 1 having an overcurrent protection function, a first input terminal N11 of a differential amplifier A1 is connected to a reference voltage source BGR1, and an output terminal O11 of the differential amplifier A1 is connected to the gate of a voltage and current controlling transistor Q1. The voltage and current controlling transistor Q1 has a source connected to an input terminal Tin1 for a power supply voltage Vin supplied from an input voltage source, and has a drain connected to an output terminal Tout1 of the voltage regulator 1. An output capacitor C1, a load L1, and a voltage divider Z1 for dividing an output voltage Vout1 occurring at the output terminal Tout1 are connected in parallel with each other between the output terminal Tout1 and a ground GND. The voltage divider Z1 is formed by a first resistance Z11 and a second resistance Z12 (the first resistance and the second resistance will hereinafter be referred to as a first voltage dividing resistance and a second voltage dividing resistance) connected between the output terminal Tout1 and the ground GND. An intermediate connection point between the first voltage dividing resistance Z11 and the second voltage dividing resistance Z12 of the voltage divider Z1 is connected as a voltage dividing point P1 of division of the output voltage Vout1 to a second input terminal N12 of the differential amplifier A1.

The reference voltage source BGR1 generates a reference voltage Vref1 serving as a reference for generating the output voltage Vout1. The reference voltage source BGR1 supplies the reference voltage Vref1 to the first input terminal N11 of the differential amplifier A1. The voltage divider Z1 divides the output voltage Vout1 occurring at the output terminal Tout1 with a voltage dividing ratio selected by the resistance values of the first voltage dividing resistance Z11 and the second voltage dividing resistance Z12 at the voltage dividing point P1 to obtain a voltage for feedback to the differential amplifier A1. The voltage divider Z1 then supplies a divided voltage Vz1 obtained by thus dividing the output voltage Vout1 to the second input terminal N12 of the differential amplifier A1.

The differential amplifier A1 amplifies a difference voltage between the reference voltage Vref1 and the divided voltage Vz1, and supplies the amplified difference voltage as a control signal for generating the output voltage to the gate of the voltage and current controlling transistor Q1. The differential amplifier A1 increases or decreases the on resistance of the voltage and current controlling transistor Q1 by the control signal, and thus controls the on resistance of the voltage and current controlling transistor Q1. According to the control of the on resistance by the control signal, the voltage and current controlling transistor Q1 controls the current value of an output current Iout1 flowing between the drain and the source. The voltage regulator 1 charges the output capacitor C1 with the output current Iout1 flowing through the voltage and current controlling transistor Q1, thus generates the output voltage Vout1 at the output terminal Tout1, and supplies the output voltage Vout1 to the load L1.

Thus, when the output voltage Vout1 is varied due to a variation in the load L1, the voltage regulator 1 feeds back the varied output voltage Vout1 as the divided voltage Vz1 to the differential amplifier A1. On the basis of the difference voltage between the reference voltage Vref1 and the divided voltage Vz1, the differential amplifier A1 controls the on resistance of the voltage and current controlling transistor Q1 such that the divided voltage Vz1 obtained by dividing the output voltage Vout1 with the voltage dividing ratio selected by the resistance values R1 and R2 of the first voltage dividing resistance Z11 and the second voltage dividing resistance Z12 becomes substantially equal to the reference voltage Vref1, as expressed by Equation (1).

[Equation 1] (1)

$$Vout = Vref \times \left[\frac{R1 + R2}{R2}\right]$$

The voltage regulator 1 can thus generate the output voltage Vout1 having a predetermined constant voltage value at the output terminal Tout1. Incidentally, Vout in Equation (1) denotes the voltage value of the output voltage Vout1. Vref denotes the voltage value of the reference voltage Vref1.

Incidentally, letting Iout be the current value of the output current Iout1 flowing to the output terminal Tout1 when the output voltage Vout1 is generated in the voltage regulator 1, a power loss Pout at the voltage and current controlling transistor Q1 at this time can be obtained by multiplying a result of subtraction of the output voltage Vout1 from the power supply voltage Vin by the output current Iout1, as expressed by Equation (2).

[Equation 2] (2)

$$Pout=(Vin-Vout)\times Iout$$

The voltage regulator 1 has an overcurrent protection circuit unit 2 connected to an intermediate connection point between the output terminal O11 of the differential amplifier A1 and the gate of the voltage and current controlling transistor Q1. At a time of operation of the voltage regulator 1, the overcurrent protection circuit unit 2 adjusts the value of the control signal supplied from the differential amplifier A1 to the gate of the voltage and current controlling transistor Q1. When the load L1 is short-circuited or becomes an overload, for example, the overcurrent protection circuit unit 2 forcefully prevents the current value Iout of the output current Iout1 from exceeding a first current value as an upper limit value selected in advance (this current value will hereinafter be referred to as an upper limit value). Therefore, the overcurrent protection circuit unit 2 prevents the output current Iout1 from flowing as an overcurrent to the load L1, and thus protects the load L1 side from heat generation or the like due to the overcurrent.

In this case, the voltage regulator 1 implements the overcurrent protection function by limiting the current value Iout of the output current Iout1 to the upper limit value or lower according to a current limiting characteristic represented with an axis of ordinates denoting the output voltage Vout1 and an axis of abscissas denoting the output current Iout1. There are three kinds of current limiting characteristics as follows. As shown in FIG. 17, a first current limiting characteristic is a drooping characteristic in which after the current value Iout of the output current Iout1 reaches the upper limit value Imax, the current value Iout of the output current Iout1 (that is, the upper limit value Imax) is held constant (this drooping characteristic will hereinafter be referred to as a constant current type drooping characteristic).

As shown in FIG. 18, another current limiting characteristic is a drooping characteristic in which after the current value Iout of the output current Iout1 reaches the upper limit value Imax, the current value Iout of the output current Iout1 (that is, the upper limit value Imax) is lowered substantially linearly to a second current value Imin1 selected in advance as a lower limit value which current value is lower than the upper limit value Imax (this second current value will hereinafter be referred to as a lower limit value) so as to describe the shape of a chevron (this drooping characteristic will hereinafter be referred to as a chevron type drooping characteristic). As shown in FIG. 19, another current limiting characteristic is a drooping characteristic in which after the current value Iout of the output current Iout1 reaches the upper limit value Imax, the current value Iout of the output current Iout1 (that is, the upper limit value Imax) is lowered exponentially to a lower limit value Imin2 selected in advance (this drooping characteristic will hereinafter be referred to as a foldback type drooping characteristic).

Thus, in operation, the conventional, typical voltage regulator 1 limits the current value Iout of the output current Iout1 to the upper limit value Imax or lower by the overcurrent protection circuit unit 2 according to one of the constant current type drooping characteristic, the chevron type drooping characteristic, and the foldback type drooping characteristic as the current limiting characteristic. When such an overcurrent protection circuit unit 2 is provided in the voltage regulator 1, however, the voltage regulator 1 adjusts the value of the control signal supplied to the voltage and current controlling transistor Q1 according to the current limiting characteristic, and limits the current value Iout of the output current Iout1 to a low value even at a time of rising of the output voltage Vout1. The voltage regulator 1 therefore takes time to charge the output capacitor C1 at the time of rising of the output voltage Vout1. Consequently, as compared with a case where the overcurrent protection circuit unit 2 is not provided, it takes a longer time for the output current Iout1 to rise to a constant voltage value.

Accordingly, there is conventionally a voltage regulator 5 formed as shown in FIG. 20. The voltage regulator 5 controls the operation of an output transistor Q2 by an operational amplifier 6 on the basis of a reference voltage Vref2 supplied from a reference voltage generating circuit 7 to the operational amplifier 6 and a divided voltage Vz2 supplied from a voltage divider circuit 8 to the operational amplifier 6 which divided voltage is obtained by dividing an output voltage Vout2. The voltage regulator 5 generates the output voltage Vout2 from a power supply voltage VDD supplied via a power supply terminal 9 by the output transistor Q2, and outputs the generated output voltage Vout2 via an output terminal 10.

In this case, the voltage regulator 5 has a current limiting circuit 11 connected to the gate of the output transistor Q2 via a current limitation control circuit 12. The operational amplifier 6 in the voltage regulator 5 is activated in response to a chip enable signal S1 externally input to the operational amplifier 6 via a CE input terminal 13. In the voltage regulator 5, the chip enable signal S1 is also input to the current limitation control circuit 12 so that the current limitation control circuit 12 disconnects the gate of the output transistor Q2 from the current limiting circuit 11 for a predetermined period of time. When the predetermined period of time thereafter passes, the voltage regulator 5 connects the gate of the output transistor Q2 and the current limiting circuit 11 to each other to limit the current value of an output current according to the constant current type drooping characteristic by the current limiting circuit 11.

Thus, the conventional voltage regulator 5 speeds the rising of the output voltage Vout2 by not limiting the output current for the predetermined period of time when the output voltage Vout2 rises to a constant voltage value in response to the input of the chip enable signal S1 (for example see Japanese Patent Laid-Open No. 2002-91579 (page 4 and page 5, FIG. 1)).

As shown in FIG. 21, when power to a conventional direct-current power supply device 15 is turned on via a switch 16, a switching circuit 17 connects a reference voltage source 18 forming an overcurrent protection circuit with the constant current type drooping characteristic to an error amplifier 19, and thereby a reference voltage is supplied to the error amplifier 19. A control circuit 20 in the direct-current power supply device 15 operates on the basis of an output of the error amplifier 19 at this time to raise an output voltage detected at an output voltage detecting terminal Vs with the constant current type drooping characteristic.

After the output voltage stabilizes, the switching circuit 17 in the direct-current power supply device 15 connects the error amplifier 19 with an intermediate connection point P2 between voltage dividing resistances Z21 and Z22 forming an overcurrent protection circuit with the chevron type drooping characteristic in place of the reference voltage source 18. The direct-current power supply device 15 supplies the error amplifier 19 with a divided voltage obtained by dividing the output voltage by the voltage dividing resistances Z21 and Z22. When a load L2 is in an overcurrent state, and a voltage drop of a current detecting resistance Z23 is greater than the divided voltage, the direct-current power supply device 15 inputs an overcurrent signal amplified by the error amplifier 19 to an overcurrent signal input terminal Is of the control circuit 20 to make the control circuit 20 operate. The direct-current power supply device 15 lowers the output voltage detected at the output voltage detecting terminal Vs in the control circuit 20, and the overcurrent protection circuit with the chevron type drooping characteristic works.

Thus, the direct-current power supply device 15 starts in a state in which the overcurrent protection circuit with the constant current type drooping characteristic is working at the time of turning on power, and after the output voltage stabilizes, the overcurrent protection circuit with the chevron type drooping characteristic works to prevent an output current from becoming an overcurrent (see Japanese Patent Laid-Open No. Sho 63-78208 (page 2 and page 3, FIG. 1)).

SUMMARY OF THE INVENTION

However, the voltage regulator 5 of the above-described configuration disconnects the gate of the output transistor Q2 from the current limiting circuit 11 at a starting time. Therefore, even when the load is short-circuited, or is an overload at the starting time, the current limiting circuit 11 does not function at all. Thus, when the load is short-circuited, or is an overload at the starting time, the voltage regulator 5 allows the output current to be an overcurrent exceeding an upper limit value, so that the output transistor Q2 and the load may generate heat.

On the other hand, the direct-current power supply device 15 of the above-configuration raises the output voltage in a state in which the overcurrent protection circuit with the constant current type drooping characteristic is working at the time of turning on power. The direct-current power supply device 15 can therefore limit the current value of the output current to an upper limit value even when the load L2 is short-circuited, or is an overload at the time of turning on power.

The direct-current power supply device 15 raises the output voltage while limiting the current value of the output current to the upper limit value by the constant current type drooping characteristic, and changes to the chevron type drooping characteristic after the output voltage stabilizes. Therefore, when the load L2 is an overload, for example, the direct-current power supply device 15 lets the output current having the relatively high upper limit value as a current limit value continue to flow for a relatively long period of time from a start of rising of the output voltage to completion of rising and stabilization of the output voltage, so that the control circuit 20, the load L2 and the like may generate heat. Therefore the direct-current power supply device 15 cannot reliably protect the device itself or the load L2.

The present invention has been made in view of the above, and it is desirable to propose a voltage regulator that can protect the regulator itself and a load.

According to an embodiment of the present invention, there is provided a voltage regulator including: control signal generating means for starting operation in response to an enable signal and generating a control signal for generating an output voltage; output controlling means for generating the output voltage by charging an output capacitor while controlling a current value of an output current flowing to the output capacitor according to the control signal generated by the control signal generating means; current limiting means for limiting the current value of the output current by a constant current type drooping characteristic that limits the current value of the output current to a first limit value and holds the current value of the output current constant by adjusting a value of the control signal when the current value of the output current reaches the first limit value, and a current limiting characteristic that limits the current value of the output current to a second limit value lower than the first limit value by adjusting the value of the control signal when the current value of the output current reaches the first limit value; and delaying means supplied with the enable signal together with the control signal generating means, for delaying the input enable signal by a delay time or less, the delay time corresponding to a certain time from a start of charging of the output capacitor to a completion of the charging of the output capacitor when the output capacitor can be normally charged to a specified capacity, and sending the delayed enable signal as a delayed signal to the current limiting means; wherein the current limiting means operates according to the constant current type drooping characteristic during a period from a point in time of a start of operation of the control signal generating means to a point in time of input of the delayed signal, and operates according to the current limiting characteristic after the point in time of the input of the delayed signal.

Thus, according to the embodiment of the present invention, by changing the constant current type drooping characteristic for limiting the current value to the current limiting characteristic in the current limiting means when the enable signal for starting the operation of the control signal generating means is delayed by the delay time or less, the delay time corresponding to a certain time from a start of charging of the output capacitor to a completion of the charging of the output capacitor when the output capacitor can be normally charged to a specified capacity, it is possible to start lowering the current value of the output current from the first limit value to the second limit value at a time point at which completion of normal charging of the output capacitor is expected, that is, a time point at which completion of rising of the output voltage is expected, at the latest. The present invention can therefore prevent the output current limited to the first limit value, which is relatively high as a limit value, from continuing to flow after the time point at which completion of rising of the output voltage is expected, thus minimizing a time during which the output current having a current value limited to the first limit value continues flowing, and thereby prevent the output controlling means, a load and the like from generating heat.

According to the embodiment of the present invention, a voltage regulator that can prevent output controlling means, a load and the like from generating heat and protect the regulator itself and the load can be realized with a simple circuit configuration without lengthening a starting time.

DETAILED DESCRIPTION OF THE PREFERRED EMBODIMENTS

One embodiment of the present invention will hereinafter be described in detail with reference to the drawings.

(1) First Embodiment

Figure 1:
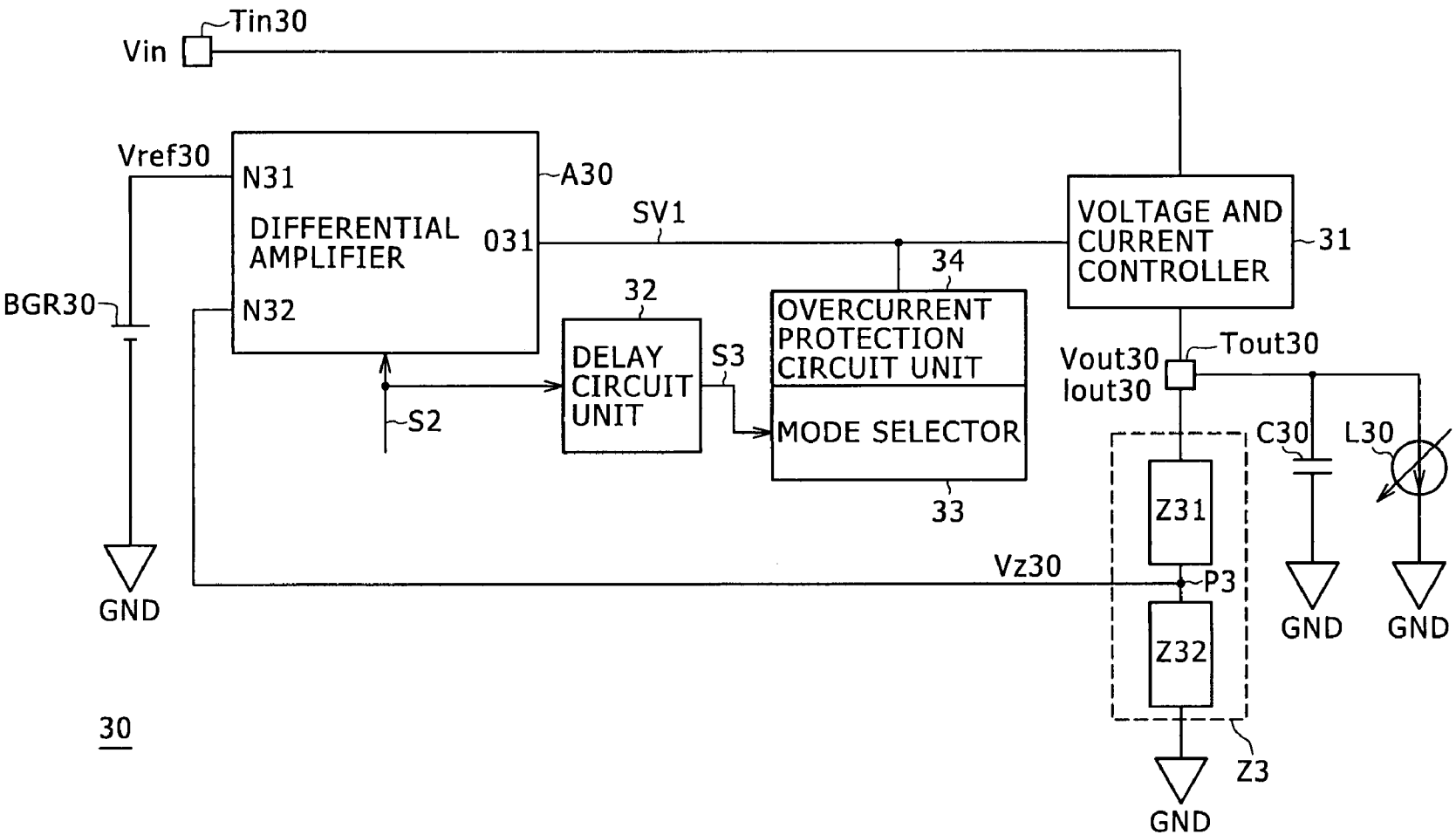
FIG. 1 is a block diagram showing a first embodiment of general configuration of a voltage regulator according to the present invention.

Reference numeral 30 in FIG. 1 denotes a voltage regulator as a whole according to a first embodiment. A first input terminal N31 of a differential amplifier A30 is connected to a reference voltage source BGR30, and an output terminal O31 of the differential amplifier A30 is connected to a voltage and current controller 31. The voltage and current controller 31 is also connected to an input terminal Tin30 supplied with a power supply voltage Vin from an input voltage source and an output terminal Tout30 of the voltage regulator 30. An output capacitor C30, a load L30, and a voltage divider Z3 for dividing an output voltage Vout30 occurring at the output terminal Tout30 are connected in parallel with each other between the output terminal Tout30 and a ground GND. The voltage divider Z3 is formed by a tenth voltage dividing resistance Z31 and an eleventh voltage dividing resistance Z32 connected between the output terminal Tout30 and the ground GND. An intermediate connection point between the tenth voltage dividing resistance Z31 and the eleventh voltage dividing resistance Z32 of the voltage divider Z3 is connected as a voltage dividing point P3 of division of the output voltage Vout30 to a second input terminal N32 of the differential amplifier A30.

The reference voltage source BGR30 generates a reference voltage Vref30 serving as a reference for generating the output voltage Vout30. The reference voltage source BGR30 supplies the reference voltage Vref30 to the first input terminal N31 of the differential amplifier A30. The voltage divider Z3 divides the output voltage Vout30 occurring at the output terminal Tout30 with a voltage dividing ratio selected by the resistance values of the tenth voltage dividing resistance Z31 and the eleventh voltage dividing resistance Z32 at the voltage dividing point P3 to obtain a voltage for feedback to the differential amplifier A30. The voltage divider Z3 then supplies a divided voltage Vz30 obtained by thus dividing the output voltage Vout30 to the second input terminal N32 of the differential amplifier A30.

The differential amplifier A30 amplifies a difference voltage between the reference voltage Vref30 and the divided voltage Vz30, and supplies the amplified difference voltage as a control signal SV1 for generating the output voltage to the voltage and current controller 31. The differential amplifier A30 increases or decreases the impedance of the voltage and current controller 31 by the control signal SV1, and thus controls the impedance of the voltage and current controller 31. According to the control of the impedance by the control signal SV1, the voltage and current controller 31 controls the current value of an output current Iout30 flowing from the input terminal Tin30 through the voltage and current controller 31 to the output terminal Tout30. The voltage regulator 30 charges the output capacitor C30 with the output current Iout30 flowing from the input terminal Tin30 through the voltage and current controller 31 to the output terminal Tout30, and thus generates the output voltage Vout30 at the output terminal Tout30.

When for example the load L30 transiently increases in a state in which the charging of the output capacitor C30 is completed and thereby the output voltage Vout30 has risen to a constant voltage value as represented by the above-described Equation (1), the voltage regulator 30 discharges a charge stored in the output capacitor C30 to the load L30. When the voltage value of the output voltage Vout30 is lowered, the voltage regulator 30 feeds back the output voltage Vout30 having the lowered voltage value as the divided voltage Vz30 to the differential amplifier A30. The voltage regulator 30 thus controls the impedance of the voltage and current controller 31 according to change in the difference voltage between the reference voltage Vref30 and the divided voltage Vz30 by the differential amplifier A30. Thereby the voltage regulator 30 charges the output capacitor C30 while increasing the current value of the output current Iout30 flowing from the input terminal Tin30 through the voltage and current controller 31 to the output terminal Tout30 so as to compensate for the decrease in the voltage value of the output voltage Vout30. The voltage regulator 30 thus increases the voltage value of the output voltage Vout30.

Thus, while the voltage regulator 30 sequentially detects the voltage value of the output voltage Vout30 as the voltage value of the divided voltage Vz30 by a loop of feedback to the differential amplifier A30 through the tenth voltage dividing resistance Z31 and the eleventh voltage dividing resistance Z32, the voltage regulator 30 controls the impedance of the voltage and current controller 31 according to a result of the detection (that is, on the basis of the difference voltage between the reference voltage Vref30 and the divided voltage Vz30). When the voltage value of the output voltage Vout30 then returns to a constant voltage value as set, the voltage regulator 30 detects the constant voltage value of the output voltage Vout30 as the voltage value of the divided voltage Vz30, and feeds back the detected voltage value to the differential amplifier A30. At this time, the voltage regulator 30 thus controls the impedance of the voltage and current controller 31 by the differential amplifier A30 on the basis of the difference voltage between the reference voltage Vref30 and the divided voltage Vz30 obtained by dividing the output voltage Vout30 having the constant voltage value. The voltage regulator 30 thereby decreases the current value of the output current Iout30 flowing from the input terminal Tin30 through the voltage and current controller 31 to the output terminal Tout30 to stop the charging of the output capacitor C30. The voltage regulator 30 thus maintains the constant voltage value of the output voltage Vout30 generated at the output terminal Tout30.

Thus, when the output voltage Vout30 varies due to a variation in the load L30, the voltage regulator 30 controls the impedance of the voltage and current controller 31 so as to make the divided voltage Vz30 varying with the output voltage Vout30 equal to the reference voltage Vref30. The voltage regulator 30 can thus generate the output voltage Vout30 having a predetermined constant voltage value at the output terminal Tout30, and maintain the constant voltage value of the output voltage Vout30.

In the case of this voltage regulator 30, when an enable signal S2 having a logical "H" level is externally input to the differential amplifier A30 in synchronism with a start of operation of the load L30 connected to the voltage regulator 30, the differential amplifier A30 starts operation in response to the input of the enable signal S2. On the other hand, when the input of the enable signal S2 is stopped in synchronism with a stop of operation of the load L30, the differential amplifier A30 stops the operation in response to the stopping of the input of the enable signal S2.

In the case of the voltage regulator 30, the externally supplied enable signal S2 is input not only to the differential amplifier A30 but also to a delay circuit unit 32. When the enable signal S2 is externally supplied to the delay circuit unit 32, the delay circuit unit 32 delays the enable signal S2 by a predetermined fixed time (which will hereinafter be referred to as a delay time), and sends the delayed signal as a delayed signal S3 to a mode selector 33.

The mode selector 33 controls an overcurrent protection circuit unit 34 in a succeeding stage such that the overcurrent protection circuit unit 34 operates according to a constant current type drooping characteristic until the delayed signal S3 is supplied from the delay circuit unit 32. When the delayed signal S3 is supplied from the delay circuit unit 32, the mode selector 33 controls the overcurrent protection circuit unit 34 in the succeeding stage such that the overcurrent protection circuit unit 34 operates according to a foldback type drooping characteristic. The mode selector 33 thus selects and controls the operation mode of the overcurrent protection circuit unit 34 according to whether the delayed signal S3 is input or not.

The overcurrent protection circuit unit 34 starts operation in such a manner as to be interlocked with a start of operation of the differential amplifier A30. When the differential amplifier A30 stops operation, the overcurrent protection circuit unit 34 stops operation in such a manner as to be interlocked with the stopping of the operation of the differential amplifier A30. While the overcurrent protection circuit unit 34 is controlled by the mode selector 33 so as to operate according to the constant current type drooping characteristic, in a case of the load L30 being short-circuited or becoming an overload, for example, the overcurrent protection circuit unit 34 adjusts the value of the control signal SV1 supplied from the differential amplifier A30 to the voltage and current controller 31 according to the constant current type drooping characteristic to limit the current value of the output current Iout30 to a first current value (which will hereinafter be referred to as an upper limit value) selected in advance as an upper limit value. While the overcurrent protection circuit unit 34 is controlled by the mode selector 33 so as to operate according to the foldback type drooping characteristic, in a case of the load L30 being short-circuited or becoming an overload, for example, the overcurrent protection circuit unit 34 adjusts the value of the control signal SV1 supplied from the differential amplifier A30 to the voltage and current controller 31 according to the foldback type drooping characteristic to lower and limit the current value of the output current Iout30 to a second current value (which will hereinafter be referred to as a lower limit value) selected in advance as a lower limit value smaller than the upper limit value.

The voltage regulator 30 includes a voltage regulator of a load separation type provided for a portable device or the like so as to be temporarily separated from the load L30 at a time of rising of the output voltage Vout30 and a voltage regulator of a load connection type provided for a portable device or the like so as not to be separated from the load L30 at a time of rising of the output voltage Vout30. When the voltage regulator 30 is of the load separation type, a time Tr1 (hereinafter referred to as a starting time) from an input of the enable signal S2 to the voltage regulator 30 in a state of no load (that is, from a start of operation of the differential amplifier A30) to completion of rising of the output voltage Vout30 to a constant voltage value is a time from a point in time of a start of charging of the output capacitor C30 to substantially a point in time of completion of the charging of the output capacitor C30, as expressed by Equation (3).

[Equation 3]

$$Tr1 = \frac{Cout \times Vot}{I\ \max} \tag{3}$$

In Equation (3), Cout denotes the capacitance of the output capacitor C30. Vct denotes the constant voltage value set as the output voltage Vout30. At a time of rising of the output voltage Vout30, when there is no limitation on the current value of the output current Iout30, the output current Iout30 having a current value higher than the upper limit value flows. However, at a time of rising of the output voltage Vout30, the current value of the output current Iout30 is limited according to the constant current type drooping characteristic to avoid occurrence of an inrush current and occurrence of an overcurrent. Imax in Equation (3) denotes the upper limit value selected to prevent the output current Iout30 from becoming an inrush current or an overcurrent.

When the voltage regulator 30 is of the load separation type, the output current Iout30 flowing to the output terminal Tout30 at a time of rising of the output voltage Vout30 is only a charging current for charging the output capacitor C30 because no current flows through the load L30. Incidentally, when the voltage regulator 30 is of the load connection type, and is in a no-load state with the load L30 separated from the voltage regulator 30, the output current Iout30 is only a charging current for charging the output capacitor C30 because no current flows through the load L30.

On the other hand, when the voltage regulator 30 is of the load connection type, the output current Iout30 flowing to the output terminal Tout30 at a time of rising of the output voltage Vout30 is a charging current for charging the output capacitor C30 and a current (hereinafter referred to as a load current) flowing into the load L30 while raising the output voltage Vout30.

Thus, when the load L30 is electrically connected to the voltage regulator 30 at a time of rising of the output voltage Vout30, the load L30 does not become an overload, and a maximum load is known in advance, a starting time Tr2 from an input of the enable signal S2 to the differential amplifier A30 (that is, from a start of operation of the differential amplifier A30) to completion of rising of the output voltage Vout30 to the constant voltage value Vct is a time from a point in time of a start of charging of the output capacitor C30 with the charging current of the charging current (that is, (Imax−Iload)) and the load current Iload as the output current Iout30 flowing to the output terminal Tout30 to substantially a point in time of completion of the charging of the output capacitor C30, as expressed by Equation (4).

[Equation 4] (4)

$$Tr2 = \frac{(Cout \times Vct)}{(I\ \max - I\ \text{load})}$$

When the voltage regulator 30 is of the load separation type, the starting time Tr1 represented by the above-described Equation (3) is selected for the delay circuit unit 32 as a delay time for delaying the enable signal S2. When the voltage regulator 30 is of the load connection type, on the other hand, the starting time Tr2 represented by the above-described Equation (4) is selected for the delay circuit unit 32 as a delay time for delaying the enable signal S2.

Figures 2A, 2B, 2C, 2D:
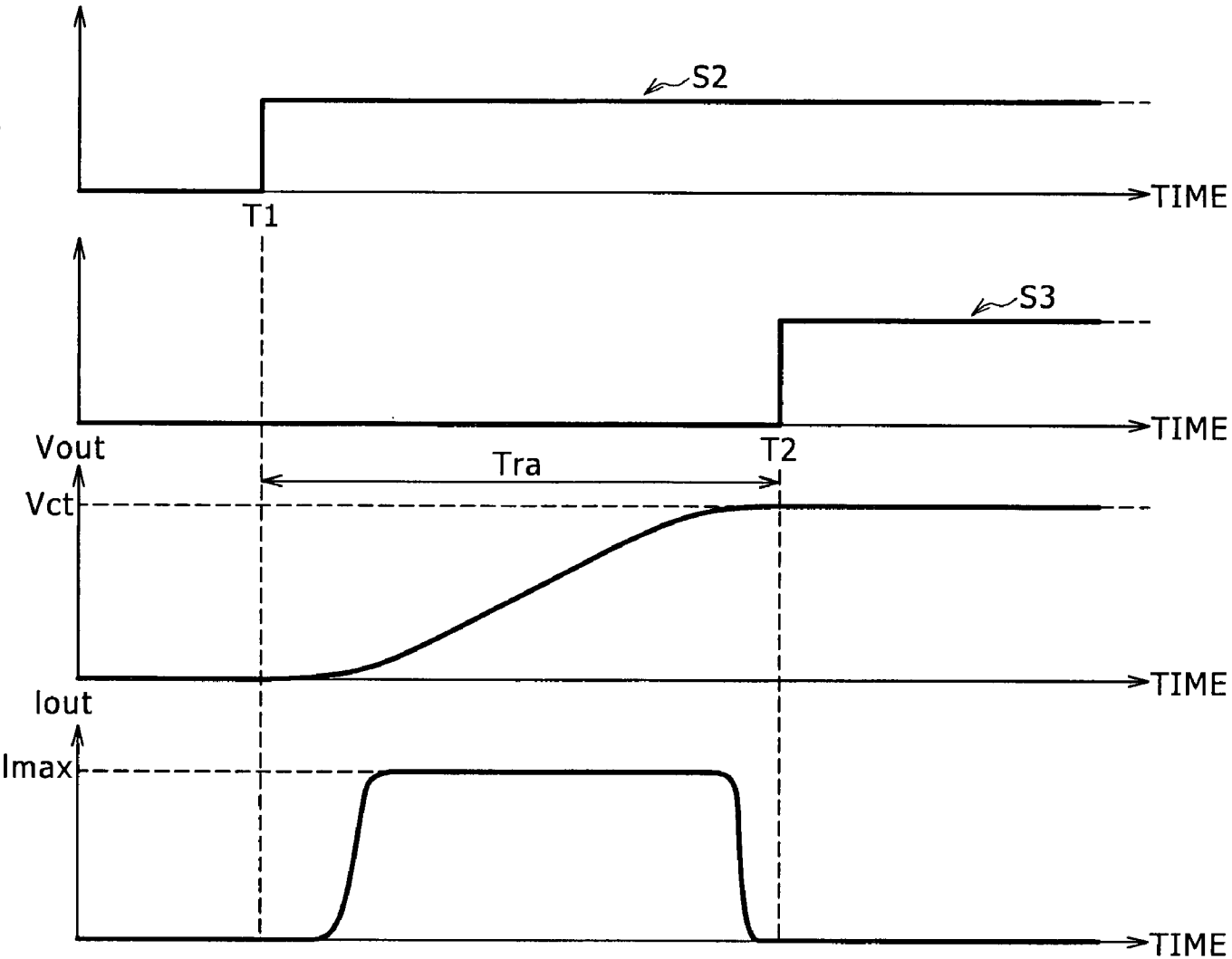
FIGS. 2A, 2B, 2C, and 2D are schematic diagrams of assistance in explaining the limitation of an output current at no load.

As shown in FIGS. 2A to 2D, while the voltage regulator 30 is of the load connection type, when the enable signal S2 (FIG. 2A) having a logical "H" level is input in a state of the load L30 being separated (that is, a no-load state), for example, the differential amplifier A30 starts operation at a point in time (hereinafter referred to as a signal input time point) T1 of the input of the enable signal S2. The differential amplifier A30 supplies the control signal SV1 to the voltage and current controller 31 to control the impedance of the voltage and current controller 31. The voltage and current controller 31 thereby increases the current value Iout of the output current Iout30 flowing from the input terminal Tin30 to the output terminal Tout30 (FIG. 2D). The overcurrent protection circuit unit 34 adjusts the value of the control signal SV1 supplied from the differential amplifier A30 to the voltage and current controller 31 according to the constant current type drooping characteristic because the delayed signal S3 is not yet supplied at this time. Thus, when the current value Iout of the output current Iout30 reaches the upper limit value Imax, the voltage and current controller 31 holds the current value Iout constant at the upper limit value Imax (FIG. 2D). Incidentally, in this case, the output current Iout30 is only a charging current for charging the output capacitor C30.

While the voltage and current controller 31 thus limits the current value Iout of the output current Iout30 to the upper limit value Imax, the voltage and current controller 31 increases the voltage value Vout of the output voltage Vout30 substantially linearly (FIG. 2C) by passing the output current Iout30 from the input terminal Tin30 to the output terminal Tout30 and charging the output capacitor C30. In a case of a no-load state even when the output voltage Vout30 has risen to the constant voltage value Vct, since a charge stored in the output capacitor C30 does not flow to the load L30, and the output voltage Vout30 is held constant at the constant voltage value Vct (that is, the reference voltage Vref30 and the divided voltage Vz30 are substantially equal to each other), the voltage and current controller 31 increases the impedance thereof according to the control signal SV1 supplied from the differential amplifier A30. As a result, the voltage and current controller 31 decreases the current value Iout of the output current Iout30 flowing from the input terminal Tin30 to the output terminal Tout30.

During this time, the delay circuit unit 32 delays the enable signal S2 from the signal input time point T1. On arriving at a point in time (hereinafter referred to as a delay end time point) T2 at which the above-described delay time Tra has passed from the signal input time point T1, the delay circuit unit 32 sends the enable signal S2 as the delayed signal S3 to the mode selector 33 (FIG. 2B). The mode selector 33 therefore controls the overcurrent protection circuit unit 34 such that the overcurrent protection circuit unit 34 operates according to the foldback type drooping characteristic from a point in time when the delayed signal S3 is input (that is, the delay end time point T2). However, when the voltage regulator 30 is in a no-load state after the delay end time point T2, no charge is discharged from the output capacitor C30 to the load L30, and the output voltage Vout30 is held constant at the constant voltage value Vct. The voltage regulator 30 therefore controls the voltage and current controller 31 by the differential amplifier A30 to maintain a state of the output current Iout30 hardly flowing. Incidentally, when the voltage regulator 30 is of the load separation type and the output voltage Vout30 rises, the voltage regulator 30 operates in the same manner as shown in FIGS. 2A to 2D.

Figures 3A, 3B, 3C, 3D:
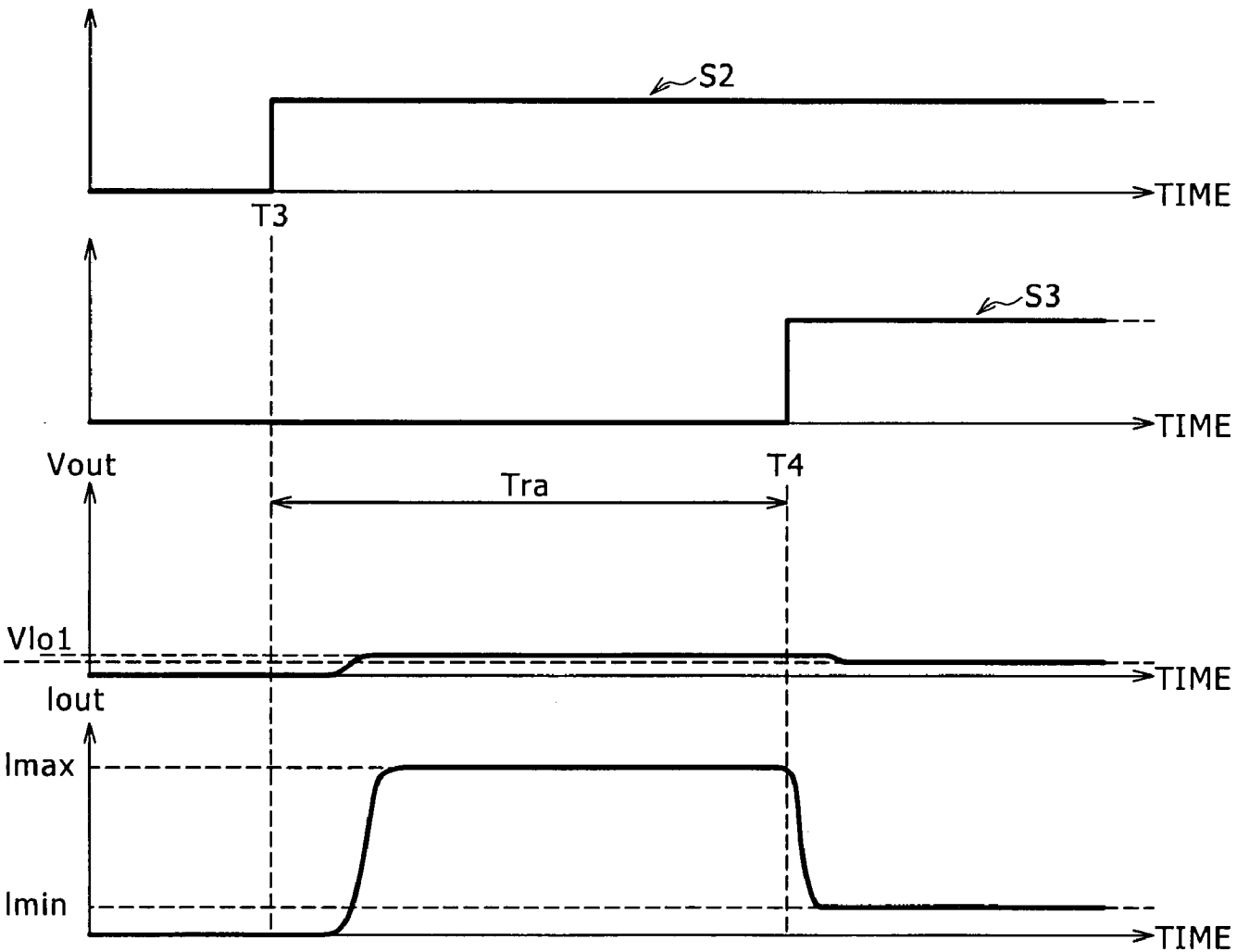
FIGS. 3A, 3B, 3C, and 3D are schematic diagrams of assistance in explaining the limitation of the output current at overload.
Figure 4:
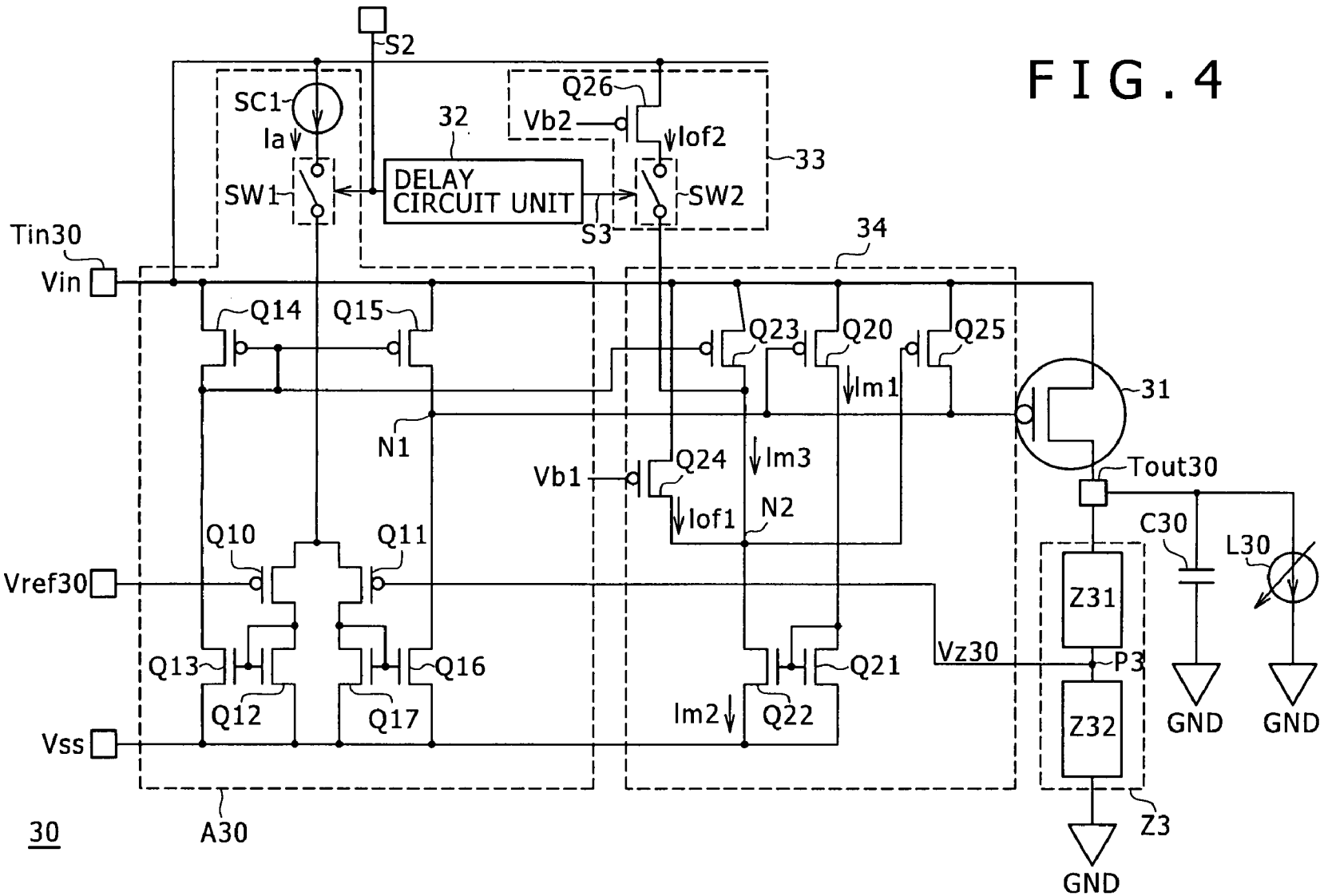
FIG. 4 is a block diagram showing details of the configuration of the voltage regulator.

On the other hand, as shown in FIGS. 3A to 3D, while the voltage regulator 30 is of the load connection type, when the enable signal S2 (FIG. 3A) is input in a state of the load L30 being increased significantly and becoming an overload, for example, the differential amplifier A30 starts operation at a signal input time point T3 of the input of the enable signal S2. The differential amplifier A30 supplies the control signal SV1 to the voltage and current controller 31 to control the impedance of the voltage and current controller 31. The voltage and current controller 31 thereby increases the current value Iout of the output current Iout30 flowing from the input terminal Tin30 to the output terminal Tout30 (FIG. 3D). The overcurrent protection circuit unit 34 adjusts the value of the control signal SV1 supplied from the differential amplifier A30 to the voltage and current controller 31 according to the constant current type drooping characteristic because the delayed signal S3 is not yet supplied at this time. Thus, when the current value Iout of the output current Iout30 reaches the upper limit value Imax, the voltage and current controller 31 holds the current value Iout constant at the upper limit value Imax (FIG. 3D).

While the output current Iout30 in the case of the load L30 being an overload flows as a charging current to the output capacitor C30 to charge the output capacitor C30 to only a very small extent when the output current Iout30 starts flowing to the output terminal Tout30 with a considerably low current value Iout, most of the output current Iout30 is thereafter drawn as the load current Iload into the load L30. The voltage and current controller 31 thus generates the output voltage Vout30 having a significantly lower voltage value Vlo1 than the constant voltage value Vct according to the current value of the charging current flowing to the output capacitor C30 in a very small amount. At this time, since most of the output current Iout30 flows as the load current Iload into the load L30, and the output current Iout30 hardly flows as the charging current even when the current value Iout of the output current Iout30 is limited to the upper limit value Imax, the output voltage Vout30 is constant at the voltage value Vlo1 without rising (FIG. 3C).

Also during this time, the delay circuit unit 32 delays the enable signal S2 from the signal input time point T3. On arriving at a delay end time point T4, the delay circuit unit 32 sends the enable signal S2 as the delayed signal S3 to the mode selector 33 (FIG. 3B). The mode selector 33 therefore controls the overcurrent protection circuit unit 34 such that the overcurrent protection circuit unit 34 operates according to the foldback type drooping characteristic from the delay end time point T4. Starting the operation according to the foldback type drooping characteristic at this time, the overcurrent protection circuit unit 34 adjusts the value of the control signal SV1 supplied from the differential amplifier A30 to the voltage and current controller 31 so as to further lower the current value Iout of the output current Iout30 from the upper limit value Imax.

The voltage and current controller 31 thus lowers the current value Iout of the output current Iout30 flowing from the input terminal Tin30 to the output terminal Tout30 from the upper limit value Imax to the lower limit value Imin and holds the current value Iout of the output current Iout30 constant as it is (FIG. 3D) by increasing the impedance of the voltage and current controller 31 from the delay end time point T4. When the current value Iout of the output current Iout30 is lowered from the upper limit value Imax to the lower limit value Imin, since most of the output current Iout30 having the lower limit value Imin flows as the load current Iload into the load L30, and a charge stored in the output capacitor C30 is discharged to the load L30, the output voltage Vout30 is lowered to a voltage value Vlo2 lower than the voltage value Vlo1 at the time of rising of the voltage value Vout, and is held constant as it is (FIG. 3C). Incidentally, when the voltage regulator 30 is of the load connection type and the output voltage Vout30 is raised in a state of the load L30 being short-circuited, the voltage regulator 30 operates in the same manner as shown in FIGS. 3A to 3D.

The configuration of the voltage regulator 30 will next be described in more detail with reference to FIGS. 4 to 12. The differential amplifier A30 has a current source SC1 connected to the input terminal Tin30. The current source SC1 outputs a constant current Ia. Sources of a pair of a first transistor Q10 and a second transistor Q11 of a P-channel MOS (Metal Oxide Semiconductor) type are commonly connected to an output terminal for outputting the current Ia via a first selector switch SW1.

In this case, the first selector switch SW1 disconnects the current source SC1 from the first transistor Q10 and the second transistor Q11 until the enable signal S2 is input externally. On the other hand, while the enable signal S2 is input externally, the first selector switch SW1 maintains electric continuity between the current source SC1 and the first transistor Q10 and the second transistor Q11.

The gate of the first transistor Q10 is supplied with the reference voltage Vref30. The gate of the second transistor Q11 is supplied with the divided voltage Vz30 generated by the voltage divider Z3. The first transistor Q10 and the second transistor Q11 are formed by the same structure, having characteristics substantially equivalent to each other. When the first transistor Q10 and the second transistor Q11 have electric continuity to the current source SC1 via the first selector switch SW1, and the reference voltage Vref30 and the divided voltage Vz30 supplied to the gates of the first transistor Q10 and the second transistor Q11 are substantially equal to each other, the first transistor Q10 and the second transistor Q11 divide the current Ia output from the current source SC1 into substantially halves, and outputs the divided current Ia as a drain current. When the divided voltage Vz30 becomes lower than the reference voltage Vref30, the first transistor Q10 and the second transistor Q11 divide the current Ia such that the drain current of the second transistor Q11 is higher than the drain current of the first transistor Q10 according to a difference voltage between the reference voltage Vref30 and the divided voltage Vz30. When the divided voltage Vz30 becomes higher than the reference voltage Vref30, the first transistor Q10 and the second transistor Q11 divide the current Ia such that the drain current of the second transistor Q11 is lower than the drain current of the first transistor Q10 according to a difference voltage between the reference voltage Vref30 and the divided voltage Vz30. Thus, the first transistor Q10 and the second transistor Q11 divide the current Ia into the drain currents of the first transistor Q10 and the second transistor Q11 according to the difference voltage between the reference voltage Vref30 and the divided voltage Vz30.

The drain of the first transistor Q10 is connected to the drain of a third transistor Q12 of an N-channel MOS type. The third transistor Q12 has a source connected to wiring of a predetermined potential Vss, and has a gate and the drain commonly connected to the gate of a fourth transistor Q13 of the N-channel MOS type. The fourth transistor Q13 has a source connected to the wiring of the predetermined potential Vss, and has a drain connected to the drain of a fifth transistor Q14 of a P-channel MOS type. In this case, the third transistor Q12 and the fourth transistor Q13 form a current mirror circuit, and generate the drain current of the fourth transistor Q13 as a mirror current proportional to the drain current of the first transistor Q10.

The fifth transistor Q14 has a source connected to the input terminal Tin30, and has a gate and the drain commonly connected to the drain of a sixth transistor Q15 of the P-channel MOS type. The sixth transistor Q15 has a source connected to the input terminal Tin30, and has the drain connected to the drain of a seventh transistor Q16 of the N-channel MOS type. In this case, the fifth transistor Q14 and the sixth transistor Q15 form a current mirror circuit, and generate the drain current of the sixth transistor Q15 as a mirror current proportional to the mirror current generated by the third transistor Q12 and the fourth transistor Q13 (that is, the drain current of the fourth transistor Q13).

The differential amplifier A30 thus generates the drain current of the sixth transistor Q15 as a mirror current proportional to the drain current of the first transistor Q10 by the third to sixth transistors Q12 to Q15.

The drain of the second transistor Q11 is connected to the drain of an eighth transistor Q17 of the N-channel MOS type. The eighth transistor Q17 has a source connected to the wiring of the predetermined potential Vss, and has a gate and the drain commonly connected to the gate of the seventh transistor Q16. The seventh transistor Q16 has a source connected to the wiring of the predetermined potential Vss, and has the drain connected to the drain of the sixth transistor Q15 as described above. In this case, the seventh transistor Q16 and the eighth transistor Q17 form a current mirror circuit, and generate the drain current of the seventh transistor Q16 as a mirror current proportional to the drain current of the second transistor Q11.

The voltage and current controller 31 is formed by a transistor of the P-channel MOS type, for example (this transistor will hereinafter be referred to specifically as a voltage and current control transistor). The voltage and current control transistor has a source connected to the input terminal Tin30, and has a drain connected to the output terminal Tout30. The gate of the voltage and current control transistor is connected to a first node N1 as an intermediate connection point between the sixth transistor Q15 and the seventh transistor Q16 (that is, the first node N1 corresponds to the output terminal O31) in the differential amplifier A30.

When the divided voltage Vz30 and the reference voltage Vref30 are substantially equal to each other, for example, after the output voltage Vout30 rises, the gate-to-source voltages of the first transistor Q10 and the second transistor Q11 in the differential amplifier A30 are substantially equal to each other. As a result, the differential amplifier A30 divides the current Ia output from the current source SC1 into substantially halves by the first transistor Q10 and the second transistor Q11. Therefore the current value of the mirror current generated by the sixth transistor Q15 and the current value of the mirror current generated by the seventh transistor Q16 in the differential amplifier A30 are substantially equal to each other. Thus, at this time, the differential amplifier A30 generates a predetermined voltage at the first node N1 according to these mirror currents, and supplies the predetermined voltage as the control signal SV1 to the gate of the voltage and current control transistor. The differential amplifier A30 thereby sets the on resistance (that is, the impedance) of the voltage and current control transistor to a predetermined value at this time.

In the differential amplifier A30, when the divided voltage Vz30 becomes lower than the reference voltage Vref30, for example, the gate-to-source voltage of the second transistor Q11 becomes lower than the gate-to-source voltage of the first transistor Q10. As a result, the differential amplifier A30 divides the current Ia output from the current source SC1 such that the second transistor Q11 has a higher current value than the first transistor Q10. Hence, in the differential amplifier A30, the current value of the mirror current generated by the seventh transistor Q16 becomes higher than the current value of the mirror current generated by the sixth transistor Q15. Therefore, at this time, the differential amplifier A30 generates a voltage lower than the above-mentioned predetermined voltage at the first node N1 (that is, a voltage proportional to the difference voltage between the reference voltage Vref30 and the divided voltage Vz30), and supplies the voltage lower than the above-mentioned predetermined voltage as the control signal SV1 to the gate of the voltage and current control transistor. The differential amplifier A30 thereby lowers the on resistance (that is, the impedance) of the voltage and current control transistor from the above-mentioned predetermined value at this time, and thus increases the output voltage Vout30 together with the output current Iout30.

In the differential amplifier A30, when the divided voltage Vz30 becomes higher than the reference voltage Vref30, for example, the gate-to-source voltage of the second transistor Q11 becomes higher than the gate-to-source voltage of the first transistor Q10. As a result, the differential amplifier A30 divides the current Ia output from the current source SC1 such that the second transistor Q11 has a lower current value than the first transistor Q10. Hence, in the differential amplifier A30, the current value of the mirror current generated by the seventh transistor Q16 becomes lower than the current value of the mirror current generated by the sixth transistor Q15. Therefore, at this time, the differential amplifier A30 generates a voltage higher than the above-mentioned predetermined voltage at the first node N1 (that is, a voltage proportional to the difference voltage between the reference voltage Vref30 and the divided voltage Vz30), and supplies the voltage higher than the above-mentioned predetermined voltage as the control signal SV1 to the gate of the voltage and current control transistor. The differential amplifier A30 thereby increases the on resistance (that is, the impedance) of the voltage and current control transistor from the above-mentioned predetermined value at this time, and thus decreases the output voltage Vout30 together with the output current Iout30.

The overcurrent protection circuit unit 34 has a P-channel MOS type transistor Q20 for detecting the output current (this transistor will hereinafter be referred to as an output current detecting transistor) having a gate connected to the first node N1 and having a source connected to the input terminal Tin30. In this case, as with the voltage and current control transistor, the gate of the output current detecting transistor Q20 is supplied with the control signal SV1 from the first node N1 of the differential amplifier A30, whereby a drain current Im1 proportional to the output current Iout30 flowing through the voltage and current control transistor (this drain current will hereinafter be referred to as an output detection current) flows through the output current detecting transistor Q20.

The drain of the output current detecting transistor Q20 is connected to the drain of a tenth transistor Q21 of the N-channel MOS type. The tenth transistor Q21 has a gate and the drain commonly connected to the gate of an eleventh transistor Q22 of the N-channel MOS type, and has a source connected to the wiring of the predetermined potential Vss together with the source of the eleventh transistor Q22. The drain of the eleventh transistor Q22 is connected to the drain of a P-channel MOS type transistor Q23 for detecting a rising state of the output voltage Vout30 (this transistor will hereinafter be referred to as a rising state detecting transistor). In this case, the tenth transistor Q21 and the eleventh transistor Q22 form a current mirror circuit, and generate the drain current of the eleventh transistor Q22 as a mirror current Im2 proportional to the output detection current Im1 of the output current detecting transistor Q20 (this mirror current Im2 will hereinafter be referred to as an output detection mirror current).

The rising state detecting transistor Q23 has a source connected to the input terminal Tin30, and has a gate connected to the gate of the fifth transistor Q14 in the differential amplifier A30. In this case, the rising state detecting transistor Q23 forms a current mirror circuit together with the fifth transistor Q14, and generates a drain current as a new mirror current (this mirror current will be referred to as a rising state detection current) Im3 proportional to the mirror current generated by the third transistor Q12 and the fourth transistor Q13 (that is, the drain current of the fourth transistor Q13) in the differential amplifier A30. That is, the rising state detecting transistor Q23 generates the rising state detection current Im3 proportional to the drain current of the first transistor Q10.

In addition, the overcurrent protection circuit unit 34 has a P-channel MOS type transistor Q24 for setting the lower limit value (this transistor will hereinafter be referred to specifically as a lower limit value setting transistor) which transistor has a source connected to the input terminal Tin30. The lower limit value setting transistor Q24 has a drain connected to a second node N2 as an intermediate connection point between the eleventh transistor Q22 and the rising state detecting transistor Q23. The lower limit value setting transistor Q24 has a gate supplied with a fixed bias voltage Vb1 to control a gate voltage, whereby a fixed first offset current Iof1 flows through the drain of the lower limit value setting transistor Q24.

Figure 5:
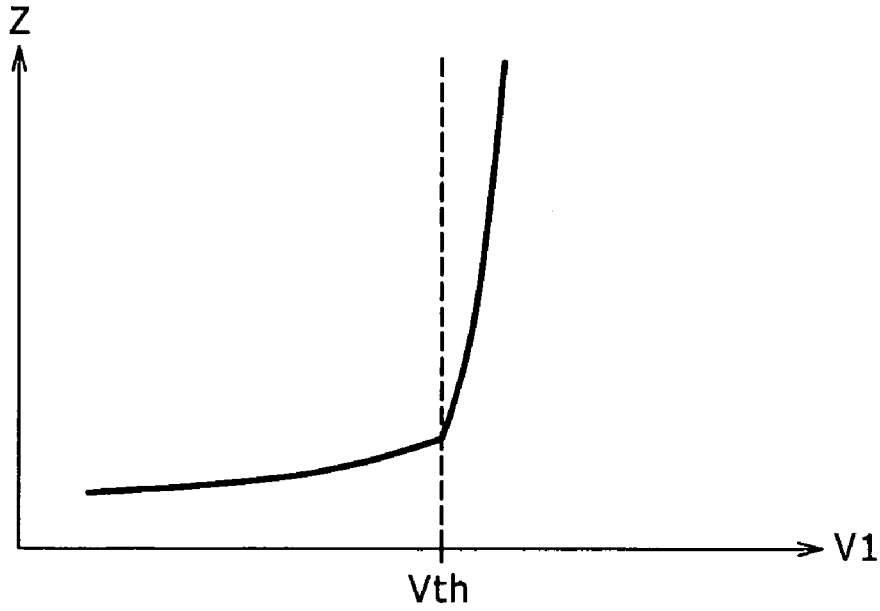
FIG. 5 is a schematic diagram showing the characteristic of a signal adjusting transistor.

The second node N2 is also connected with the gate of a P-channel MOS type transistor Q25 for adjusting the control signal (this transistor will hereinafter be referred to specifically as a signal adjusting transistor). The signal adjusting transistor Q25 has a source connected to the input terminal Tin30, and has a drain connected to the first node N1 of the differential amplifier A30. In this case, as shown in FIG. 5, when a voltage V1 occurring at the second node N2 is supplied to the gate of the signal adjusting transistor Q25, and the voltage V1 is higher than a predetermined threshold voltage Vth, the signal adjusting transistor Q25 has a higher impedance than a predetermined value, and does not attenuate (that is, adjust) the value of the control signal SV1 at all by the high impedance. When the voltage V1 at the second node N2 becomes lower than the predetermined threshold voltage Vth, the signal adjusting transistor Q25 makes the impedance lower than the predetermined value substantially in proportion to the voltage V1, and thereby attenuates and adjusts the value of the control signal SV1 according to the value of the impedance.

Further, the mode selector 33 has a P-channel MOS type transistor Q26 for setting the upper limit value (this transistor will hereinafter be referred to specifically as an upper limit value setting transistor) which transistor has a source connected to the input terminal Tin30. The upper limit value setting transistor Q26 has a drain connected to the second node N2 in the overcurrent protection circuit unit 34 via a second selector switch SW2. In this case, the upper limit value setting transistor Q26 has a gate supplied with a fixed bias voltage Vb2 to control a gate voltage, whereby a fixed second offset current Iof2 flows through the drain of the upper limit value setting transistor Q26. The second selector switch SW2 provides electric continuity between the upper limit value setting transistor Q26 and the second node N2 until the delayed signal S3 is input from the delay circuit unit 32. On the other hand, while the delayed signal S3 is input from the delay circuit unit 32, the second selector switch SW2 disconnects the upper limit value setting transistor Q26 from the second node N2.

Figures 6A, 6B, 6C, 6D, 6E, 6F:
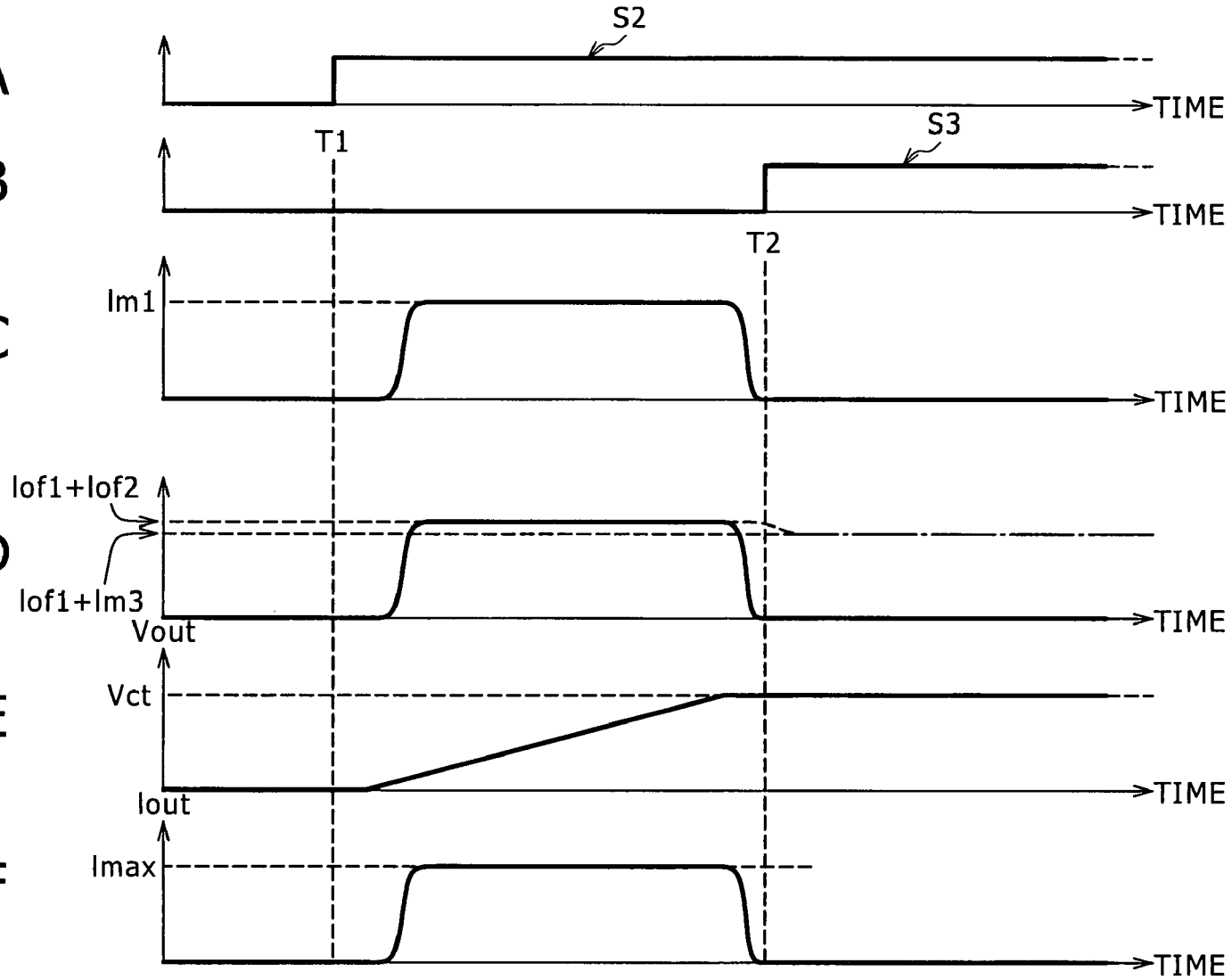
FIGS. 6A, 6B, 6C, 6D, 6E, and 6F are schematic diagrams of assistance in explaining the limitation of the output current at no load.

In such a configuration, as shown in FIGS. 6A to 6F, while the voltage regulator 30 is for example of the load connection type, when the voltage regulator 30 is in a no-load state with the load L30 disconnected therefrom, the differential amplifier A30 starts operation in response to an input of the enable signal S2 (FIG. 6A). At a point in time of this start of operation, while the reference voltage Vref30 is supplied to the gate of the first transistor Q10, the divided voltage Vz30 is not yet supplied to the gate of the second transistor Q11 because the output voltage Vout30 is not yet generated. The differential amplifier A30 thus makes the current Ia supplied from the current source SC1 to the first transistor Q10 and the second transistor Q11 via the first selector switch SW1 hardly flow through the first transistor Q10 but flow through the second transistor Q11.

Therefore the rising state detection current Im3 hardly flows through the rising state detecting transistor Q23 in the overcurrent protection circuit unit 34. Incidentally, the rising state detecting transistor Q23 is formed so as to hardly pass the rising state detection current Im3 until the output voltage Vout30 rises, and pass the rising state detection current Im3 proportional to the drain current flowing in the first transistor Q10 from a point in time when the output voltage Vout30 has risen. At the point in time of the start of operation of the differential amplifier A30, the output current Iout30 hardly flows through the voltage and current control transistor yet. Therefore the output detection current Im1 hardly flows through the output current detecting transistor Q20 in the overcurrent protection circuit unit 34. As a result, the output detection mirror current Im2 hardly flows through the eleventh transistor Q22.

At this time, in order to make the overcurrent protection circuit unit 34 operate according to the constant current type drooping characteristic, the mode selector 33 generates the second offset current Iof2 by the upper limit value setting transistor Q26 according to the bias voltage Vb2 supplied to the gate of the upper limit value setting transistor Q26, and supplies the second offset current Iof2 to the second node N2 of the overcurrent protection circuit unit 34 via the second selector switch SW2. In addition, the lower limit value setting transistor Q24 in the overcurrent protection circuit unit 34 generates the first offset current Iof1 according to the bias voltage Vb1 supplied to the gate of the lower limit value setting transistor Q24, and supplies the first offset current Iof1 to the second node N2.

Figure 7:
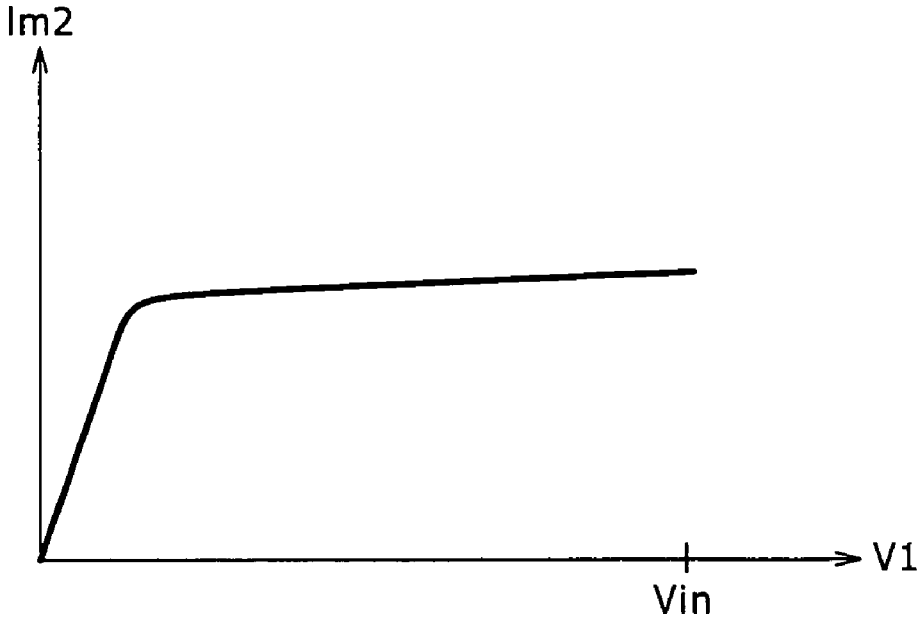
FIG. 7 is a schematic diagram of assistance in explaining a relation between a voltage at a second node and an output detection mirror current.

As shown in FIG. 7, the eleventh transistor Q22 is designed to operate in a non-saturation region when the voltage V1 at the second node N2 is lower than a predetermined voltage value (that is, when the drain-to-source voltage is relatively low). The output detection mirror current Im2 is decreased as the voltage V1 is lowered. When the voltage value of the voltage V1 becomes 0 [V], the current value of the output detection mirror current Im2 also becomes 0 [A]. When the voltage V1 at the second node N2 is higher than the predetermined voltage value (that is, when the drain-to-source voltage is relatively high), the eleventh transistor Q22 operates in a saturation region, and thus the current value of the output detection mirror current Im2 is substantially constant irrespective of the voltage value of the voltage V1. However, as will be described later, the eleventh transistor Q22 actually operates only in a saturation region because the second node N2 acts to balance a combined current of the first offset current Iof1 and the second offset current Iof2 (this combined current will hereinafter be referred to as an offset combined current) with the output detection mirror current Im2.

Figure 8:
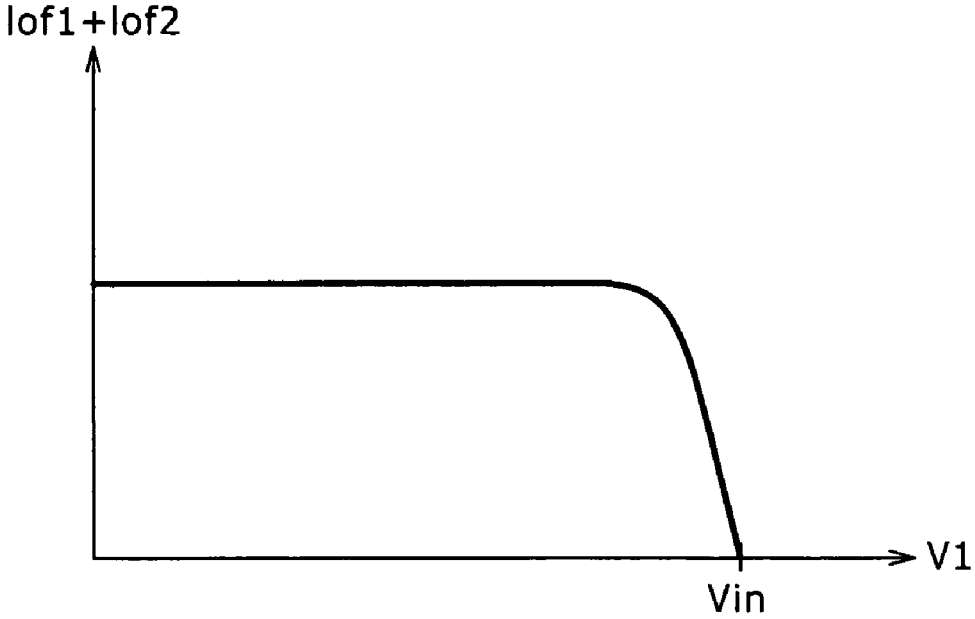
FIG. 8 is a schematic diagram of assistance in explaining a relation between the voltage at the second node and a combined current.

The second offset current Iof2 generated by the upper limit value setting transistor Q26 is combined with the first offset current Iof1 generated by the lower limit value setting transistor Q24. As a result, the combined current of the first offset current Iof1 and the second offset current Iof2 (that is, the offset combined current) is a setting current for limiting the output current Iout30 to the upper limit value Imax. As shown in FIG. 8, the lower limit value setting transistor Q24 and the upper limit value setting transistor Q26 operate in a non-saturation region when the voltage value of the voltage V1 at the second node N2 is close to the voltage value of the power supply voltage Vin (that is, when the drain-to-source voltage is relatively low). In this case, the offset combined current is decreased substantially linearly with increase in the voltage V1, and becomes a current value of 0 [A] when the voltage value of the voltage V1 becomes equal to the voltage value of the power supply voltage Vin. The lower limit value setting transistor Q24 and the upper limit value setting transistor Q26 operate in a saturation region when the voltage V1 at the second node N2 is lower than a predetermined voltage value. In this case, the offset combined current has a substantially constant current value irrespective of the voltage value of the voltage V1.

Figure 9:
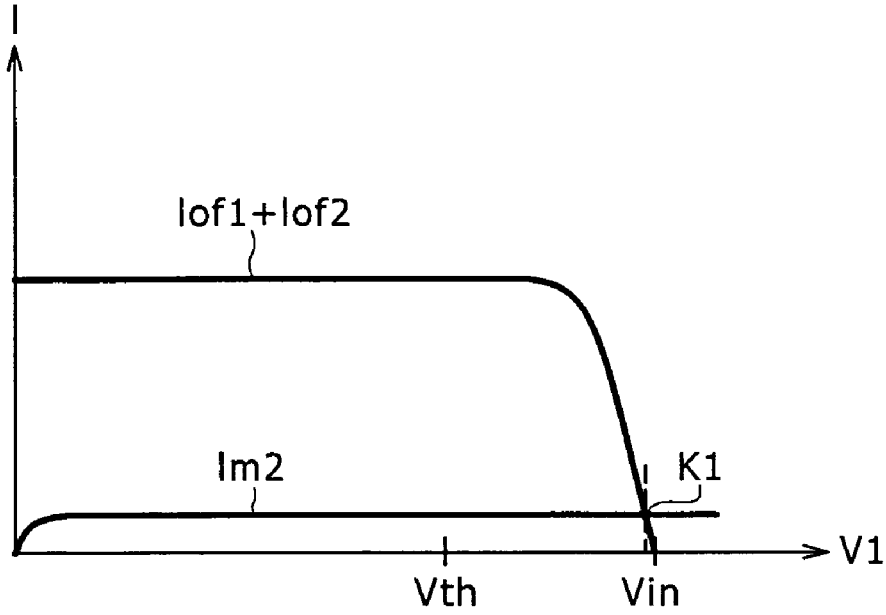
FIG. 9 is a schematic diagram of assistance in explaining the voltage at the second node at a time of a start of operation of a differential amplifier.

The second node N2 acts to balance the combined current flowing on the side of the input terminal Tin30 (FIG. 6D) with the output detection mirror current Im2 flowing on the side of the wiring of the predetermined potential Vss. Hence, the voltage V1 having a voltage value corresponding to a point of intersection of voltage-current characteristic curves shown in FIG. 7 and FIG. 8 occurs at the second node N2. In such conditions, as shown in FIG. 9, the current value of the output detection mirror current Im2 is lower than the constant current value of the offset combined current at the point in time of a start of operation of the differential amplifier A30. The eleventh transistor Q22 operates in a saturation region at this time. The lower limit value setting transistor Q24 and the upper limit value setting transistor Q26 lower the drain-to-source voltage and thus operate in a non-saturation region. Therefore, as indicated by an intersection point K1 in FIG. 9, the voltage V1 in the vicinity of the power supply voltage Vin higher than the predetermined threshold voltage Vth is generated at the second node N2. This voltage V1 is supplied to the gate of the signal adjusting transistor Q25. As a result, the signal adjusting transistor Q25 has a high impedance according to the voltage value of the voltage V1 at this time, and thus supplies the control signal SV1 formed by the difference voltage occurring at the first node N1 of the differential amplifier A30 to the gate of the voltage and current control transistor as it is. Thereby the voltage and current control transistor starts raising the output voltage Vout30 (FIG. 6E) by starting passing the output current Iout30 (FIG. 6F) to the output terminal Tout30 according to the control signal SV1 and thus starting charging the output capacitor C30.

After the voltage and current control transistor starts passing the output current Iout30 to the output terminal Tout30, the voltage and current control transistor increases the impedance according to the control signal SV1 supplied from the differential amplifier A30. As a result, the voltage and current control transistor increases the current value Iout of the output current Iout30 (FIG. 6F). Then, when the current value Iout of the output current Iout30 reaches the upper limit value Imax, and the output detection current Im1 proportional to the output current Iout30 having the upper limit value Imax flows through the output current detecting transistor Q20 (FIG. 6C), the eleventh transistor Q22 in the overcurrent protection circuit unit 34 generates the output detection mirror current Im2 proportional to the output detection current Im1.

Figure 10:
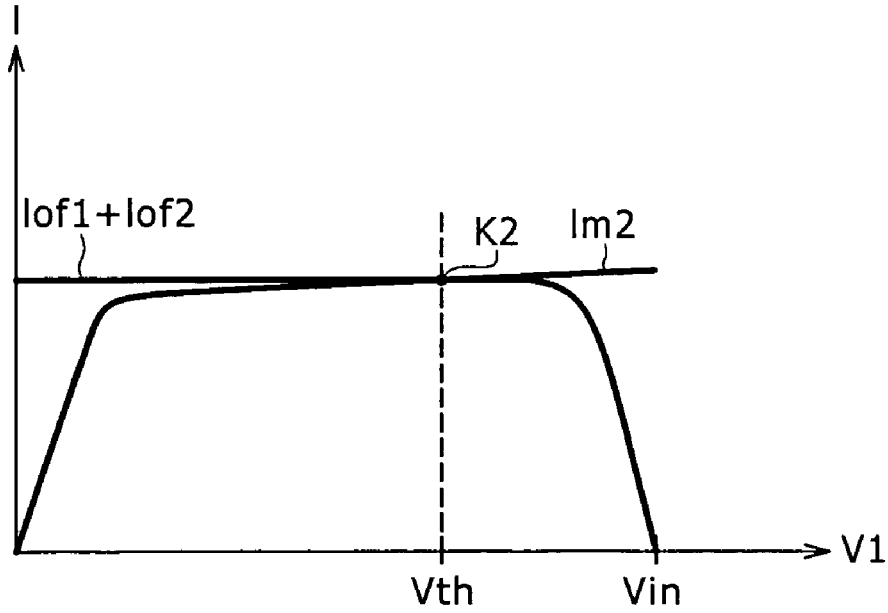
FIG. 10 is a schematic diagram of assistance in explaining the voltage at the second node when an output voltage reaches an upper limit value according to a constant current type drooping characteristic.

At this time, as shown in FIG. 10, the current value of the output detection mirror current Im2 becomes substantially equal to the constant current value of the offset combined current. The eleventh transistor Q22 operates in the saturation region also at this time. The lower limit value setting transistor Q24 and the upper limit value setting transistor Q26 raise the drain-to-source voltage and thus operate in a saturation region. Therefore, as indicated by an intersection point K2 in FIG. 10, the voltage V1 substantially equal to the threshold voltage Vth is generated at the second node N2. This voltage V1 is supplied to the gate of the signal adjusting transistor Q25. As a result, the signal adjusting transistor Q25 has a low impedance according to the voltage value of the voltage V1 at this time. The control signal SV1 formed by the difference voltage such as to greatly lower the impedance of the voltage and current control transistor (that is, such as to further increase the current value Iout of the output current Iout30) is generated at this time at the first node N1 of the differential amplifier A30. However, since the impedance of the signal adjusting transistor Q25 is lowered at this time, the signal adjusting transistor Q25 attenuates the control signal SV1 occurring at the first node N1 by drawing up the control signal SV1 to the input terminal Tin30 side, and supplies the attenuated control signal SV1 to the gate of the voltage and current control transistor. Thereby the impedance of the voltage and current control transistor becomes constant according to the attenuated control signal SV1, and thus limits the current value Iout of the output current Iout30 flowing to the output terminal Tout30 to the upper limit value Imax.

Thus, the overcurrent protection circuit unit 34 increases and raises the voltage value Vout of the output voltage Vout30 substantially linearly (FIG. 6E) by passing the output current Iout30 to the output capacitor C30 and charging the output capacitor C30 with the output current Iout30 while limiting the current value Iout of the output current Iout30 to the upper limit value Imax. When the output voltage Vout30 has risen to the constant voltage value Vct to be constant, the differential amplifier A30 generates the control signal SV1 formed by such a predetermined voltage as to increase the impedance of the voltage and current control transistor at the first node N1 according to the substantially equal mirror currents generated by the sixth transistor Q15 and the seventh transistor Q16, and supplies the control signal SV1 to the gate of the voltage and current control transistor. Thereby, according to the control signal SV1, the voltage and current control transistor makes the impedance higher than when the current value of the output current Iout30 is limited to the upper limit value Imax, so that the output current Iout30 hardly flows to the output terminal Tout30 (FIG. 6F). Therefore the output detection current Im1 hardly flows through the output current detecting transistor Q20 at this time (FIG. 6C). As a result, the output detection mirror current Im2 hardly flows through the eleventh transistor Q22.

The delay circuit unit 32 sets the point in time at which the output voltage Vout30 has thus risen to substantially the constant voltage value Vct in a no-load state as a delay end time point T2 at which to end the delaying of the enable signal S2. The delay circuit unit 32 sends the enable signal S2 that has been delayed until the delay end time point T2 to the mode selector 33 as the delayed signal S3 at the delay end time point T2. The delay circuit unit 32 in the mode selector 33 thereby opens the contact of the second selector switch SW2 by the delayed signal S3 (FIG. 6B). The upper limit value setting transistor Q26 in the mode selector 33 therefore stops passing the second offset current Iof2 to the second node N2 in the overcurrent protection circuit unit 34 from the delay end time point T2. The overcurrent protection circuit unit 34 is thus made to function according to the foldback type drooping characteristic in place of the constant current type drooping characteristic.

At this time, the rising state detecting transistor Q23 in the overcurrent protection circuit unit 34 generates the rising state detection current Im3 proportional to the drain current flowing through the first transistor Q10 in the differential amplifier A30 in response to the rising of the output voltage Vout30, and sets the rising state detection current Im3 flowing to the second node N2. From the delay end time point T2, the first offset current Iof1 generated by the lower limit value setting transistor Q24 forms a combined current together with the rising state detection current Im3 (FIG. 6D) in place of the second offset current Iof2. The combined current is a setting current for limiting the output current Iout30 according to the foldback type drooping characteristic. In this case, the lower limit value setting transistor Q24 operates with the rising state detecting transistor Q23 in substantially the same manner as in the case of the lower limit value setting transistor Q24 and the upper limit value setting transistor Q26 described above with reference to FIG. 8. Thus the current value of the combined current of the first offset current Iof1 and the rising state detection current Im3 basically changes in the same manner as the offset combined current according to change in the voltage value of the voltage V1 at the second node N2.

The second node N2 acts to balance the combined current of the first offset current Iof1 and the rising state detection current Im3 flowing on the side of the input terminal Tin30 (FIG. 6D) with the output detection mirror current Im2 flowing on the side of the wiring of the predetermined potential Vss. Hence, when the load L30 is no load, the output detection mirror current Im2 does not flow at the second node N2 together with the output current Iout30 and the output detection current Im1. Therefore the combined current of the first offset current Iof1 and the rising state detection current Im3 does not flow at all.

Thus, when the load L30 is no load, the overcurrent protection circuit unit 34, together with the mode selector 33, can raise the output voltage Vout30 to the constant voltage value Vct while limiting the current value Iout of the output current Iout30 to the upper limit value Imax according to the constant current type drooping characteristic.

Incidentally, until the overcurrent protection circuit unit 34 starts limiting the current value Iout of the output current Iout30, the eleventh transistor Q22 operates in a saturation region. The lower limit value setting transistor Q24 and the upper limit value setting transistor Q26 operate with the voltage V1 occurring at the second node N2 in a range of the threshold voltage Vth to the power supply voltage Vin. The overcurrent protection circuit unit 34 can therefore reduce a current flowing from the lower limit value setting transistor Q24 and the upper limit value setting transistor Q26 to the eleventh transistor Q22 to a very low value. In particular, since the output detection mirror current Im2 generated by the eleventh transistor Q22 becomes substantially 0 [A] after the output voltage Vout30 rises to the constant voltage value Vct when the load L30 is no load in the case of the load connection type or when the load L30 is disconnected in the case of the load separation type, the overcurrent protection circuit unit 34 can reduce the current flowing from the lower limit value setting transistor Q24 and the upper limit value setting transistor Q26 to the eleventh transistor Q22 to substantially 0 [A]. The overcurrent protection circuit unit 34 can thus reduce current consumption to substantially zero after the output voltage Vout30 rises to the constant voltage value Vct.

When the load L30 is an overload, as described above with reference to FIGS. 3A to 3D, the output current Iout30 having the upper limit value Imax flows to the output terminal Tout30 at the delay end time point T4 at which the constant current type drooping characteristic is changed to the foldback type drooping characteristic. In this case, the output detection current Im1 proportional to the output current Iout30 having the current value Iout limited to the upper limit value Imax flows through the output current detecting transistor Q20 in the overcurrent protection circuit unit 34. Consequently, the eleventh transistor Q22 generates the output detection mirror current Im2 proportional to the output detection current Im1. At this time, the eleventh transistor Q22 operates in a saturation region. The lower limit value setting transistor Q24 and the rising state detecting transistor Q23 also operate in a saturation region.

However, at this time, the voltage value Vout of the output voltage Vout30 is the voltage value Vlo1, which is much lower than the constant voltage value Vct, and accordingly the rising state detecting transistor Q23 generates the rising state detection current Im3 having a very low current value. The rising state detecting transistor Q23 therefore has a higher drain-to-source voltage than the lower limit value setting transistor Q24 and the upper limit value setting transistor Q26 described above with reference to FIG. 10. Hence, the voltage V1 having a voltage value lower than the voltage value of the threshold voltage Vth is generated at the second node N2, and is supplied to the gate of the signal adjusting transistor Q25. As a result, the signal adjusting transistor Q25 has an even lower impedance than in the case described with reference to FIG. 10 according to the voltage value of the voltage V1 at this time. The signal adjusting transistor Q25 attenuates the control signal SV1 occurring at the first node N1 in the differential amplifier A30 by drawing up the control signal SV1 to the input terminal Tin30 side more than in the case described with reference to FIG. 10, and supplies the attenuated control signal SV1 to the gate of the voltage and current control transistor. Thereby the impedance of the voltage and current control transistor becomes high according to the attenuated control signal SV1. The voltage and current control transistor lowers the current value of the output current Iout30 flowing to the output terminal Tout30 below the upper limit value Imax, and simultaneously starts lowering the voltage value Vout of the output voltage Vout30.

Figure 11:
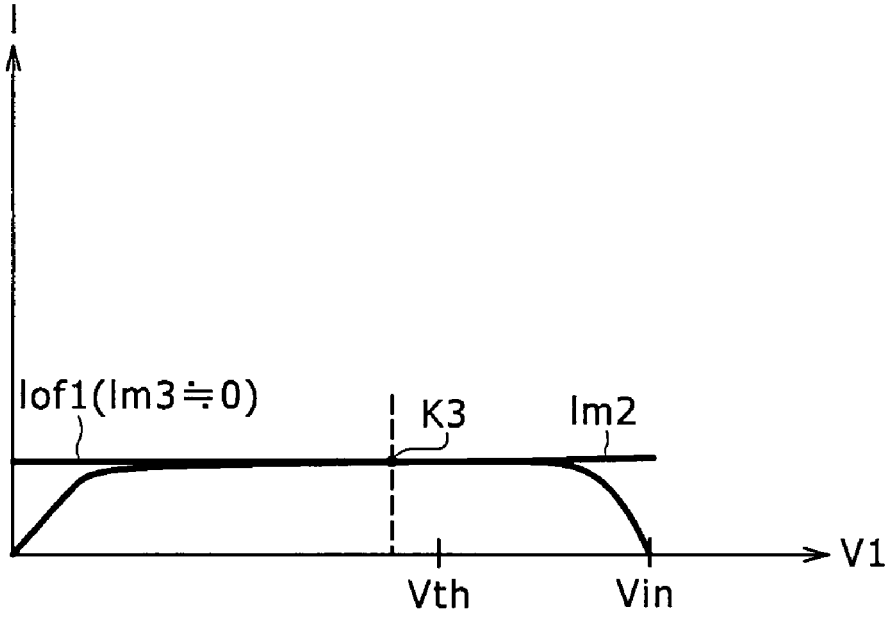
FIG. 11 is a schematic diagram of assistance in explaining the voltage at the second node when the output voltage is limited to a lower limit value according to a foldback type drooping characteristic.

Thus the rising state detecting transistor Q23 generates the rising state detection current Im3 having an even lower current value according to the lowering of the output voltage Vout30, and accordingly further raises the drain-to-source voltage. As a result, the voltage value of the voltage V1 occurring at the second node N2 is further lowered, and the output voltage Vout30 is correspondingly lowered together with the output current Iout30. When the voltage value Vout of the output voltage Vout30 becomes substantially 0 [V], the current value of the rising state detection current Im3 generated by the rising state detecting transistor Q23 also becomes substantially 0 [A]. Thus the first offset current Iof1 having a constant current value flows from the lower limit value setting transistor Q24 into the eleventh transistor Q22. Thereby, as shown in FIG. 11, the eleventh transistor Q22 and the lower limit value setting transistor Q24 both operate in a saturation region, accordingly generate the voltage V1 having a voltage value lower than the voltage value of the threshold voltage Vth at the second node N2, and supplies the voltage V1 to the gate of the signal adjusting transistor Q25.

The signal adjusting transistor Q25 thereby has an even lower impedance according to the voltage value of the voltage V1 at this time. The signal adjusting transistor Q25 attenuates the control signal SV1 occurring at the first node N1 in the differential amplifier A30 by drawing up the control signal SV1 to the input terminal Tin30 side even more, and supplies the attenuated control signal SV1 to the gate of the voltage and current control transistor. Thereby the impedance of the voltage and current control transistor becomes high according to the attenuated control signal SV1. The voltage and current control transistor limits the current value of the output current Iout30 flowing to the output terminal Tout30 to the lower limit value Imin.

Figure 12:
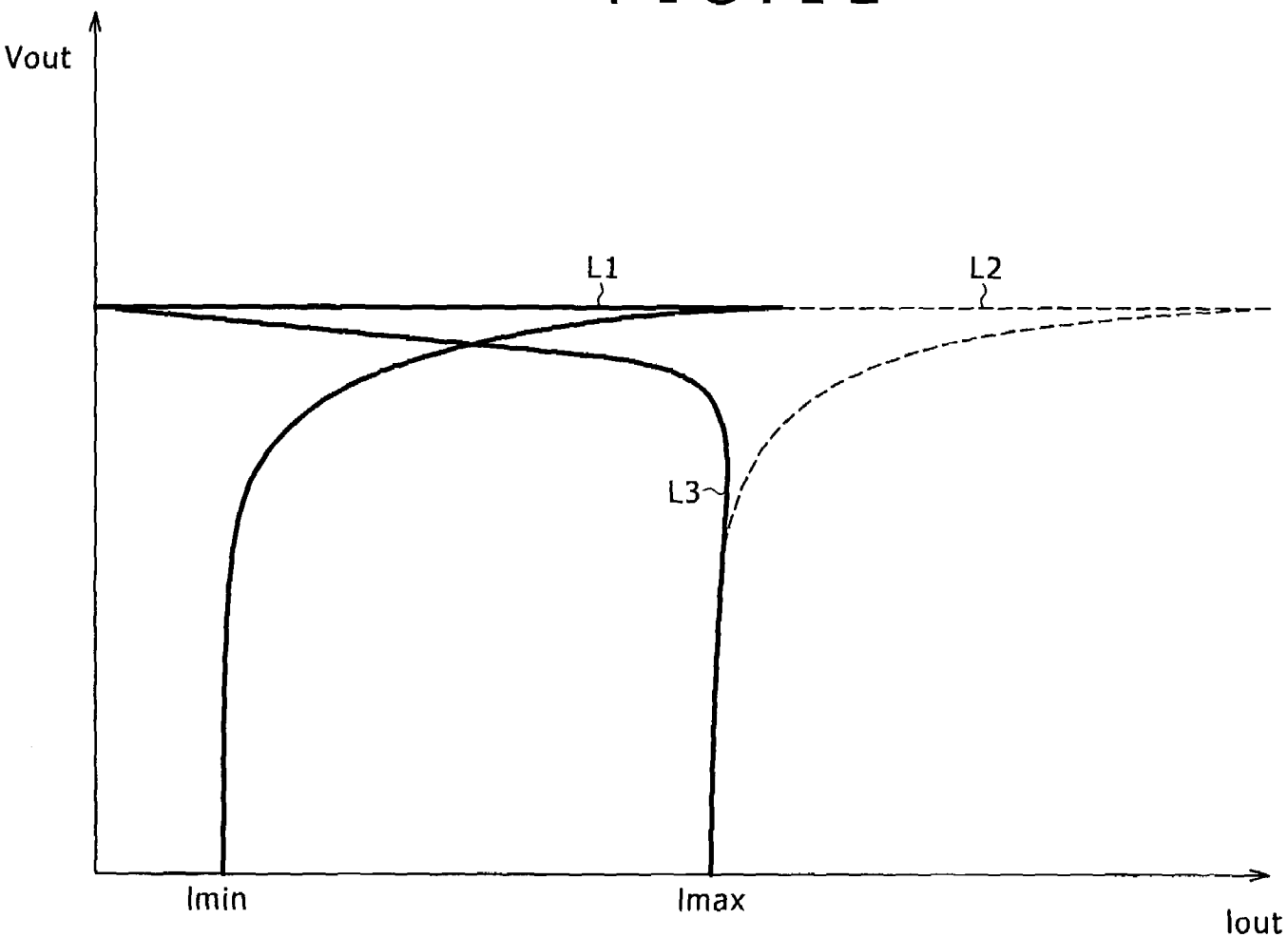
FIG. 12 is a schematic diagram showing a voltage-current characteristic at a time of rising of the output voltage.

Thus, as shown in FIG. 12, at the time of rising of the output voltage Vout30, the voltage regulator 30 supplies the second offset current Iof2 from the mode selector 33 to the second node N2 in the overcurrent protection circuit unit 34, and uses the second offset current Iof2 in place of the rising state detection current Im3, together with the first offset current Iof1. Therefore, as represented by a broken line L2, it appears that the upper limit value Imax of the foldback type drooping characteristic L1 in the overcurrent protection circuit unit 34 in the voltage regulator 30 is increased greatly by an amount corresponding to the second offset current Iof2 added in place of the rising state detection current Im3, and that the lower limit value Imin is also increased to be substantially equal to the original upper limit value Imax, for example. However, the voltage regulator 30 restores the limitation on the output current Iout30 (that is, uses the rising state detection current Im3 in place of the second offset current Iof2) when the output voltage Vout30 rises to the constant voltage value Vct, so that a function of protection against an overcurrent can be performed without any problem. In the voltage regulator 30, as the output voltage Vout30 is rising, the difference voltage between the reference voltage Vref30 and the divided voltage Vz30 input to the differential amplifier A30 is decreased, and the output of the differential amplifier A30 is thus changed. Therefore, in the voltage regulator 30, by providing a sufficient phase margin, the output voltage Vout30 rises following a locus represented by a solid line L3 even when the foldback type drooping characteristic L1 is an apparent characteristic represented by the broken line L2.

Figure 13:
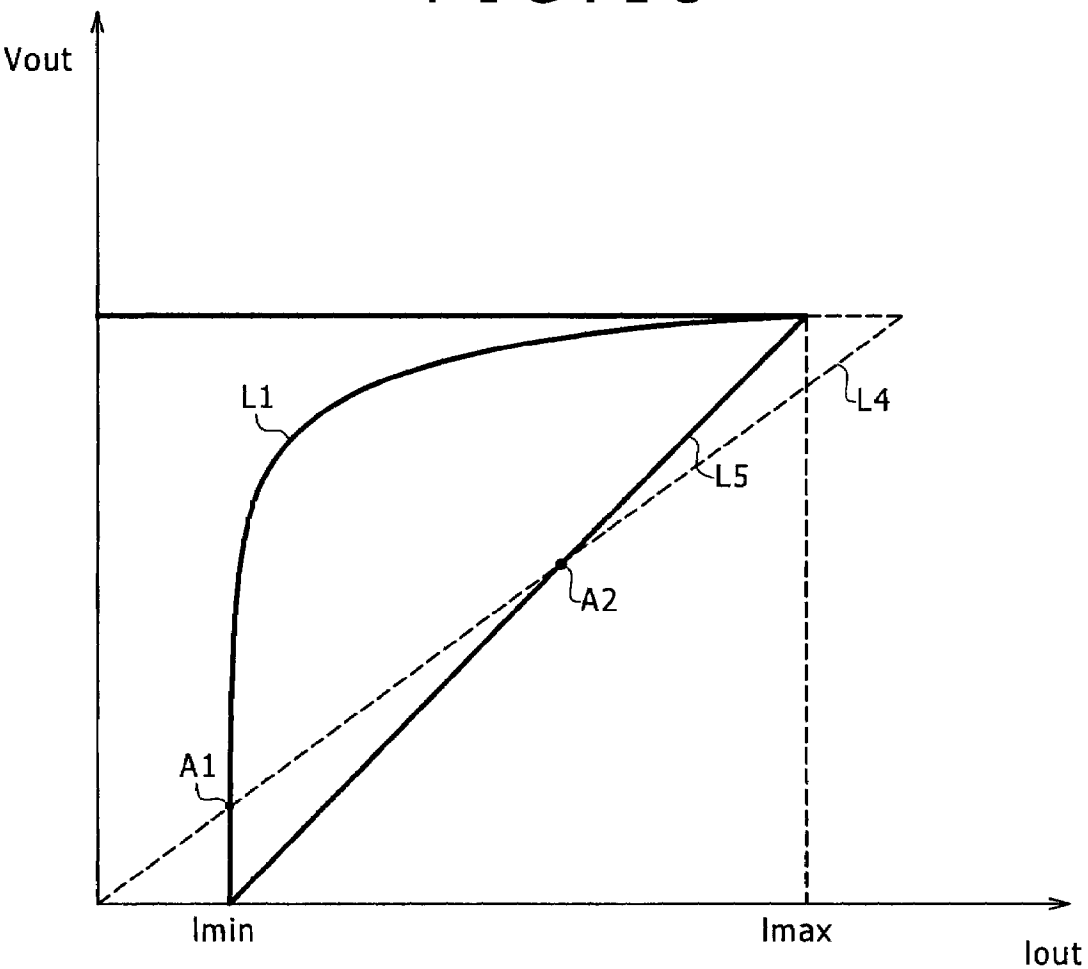
FIG. 13 is a schematic diagram of assistance in explaining a stop of decrease in the output current and the output voltage in the course of limiting the output current.

As shown in FIG. 13, there is a case where the voltage regulator 30 limits the current value Iout of the output current Iout30 according to the foldback type drooping characteristic L1 when conditions are changed such that after the load L30 becomes an overload and an overcurrent temporarily flows in a state in which a current limiting characteristic for limiting the output current is changed from the constant current type drooping characteristic to the foldback type drooping characteristic L1, the output current Iout30 having a constant current value between the overcurrent and the upper limit value Imax flows to the load L30. Then, there is a case where when the foldback type drooping characteristic L1 at this time balances a voltage-current decrease characteristic L4 that decreases the output current Iout30 and the output voltage Vout30 substantially linearly in the load L30, the voltage regulator 30 does not decrease the output current Iout30 supplied to the load L30 together with the output voltage Vout30 during a decrease in the output current Iout30 before the output current Iout30 reaches the lower limit value Imin.

Figure 21:
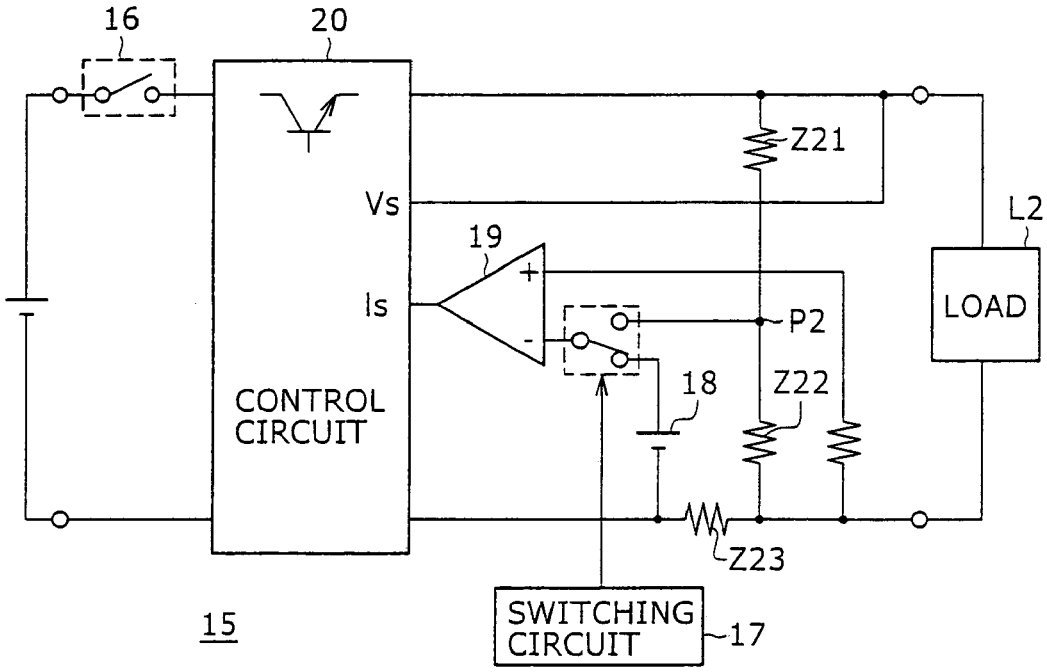
FIG. 21 PRIOR ART
FIG. 21 is a block diagram showing a configuration of a conventional direct-current power supply device.

Also in a power supply circuit that limits the current value Iout of the output current Iout30 by a chevron type drooping characteristic L5 as in the conventional direct-current power supply device 15 (FIG. 21), there is a case where when similar conditions to those in the voltage regulator 30 according to the first embodiment occur and the chevron type drooping characteristic L5 balances the voltage-current decrease characteristic L4, the output current Iout30 supplied to the load L30 is not decreased together with the output voltage Vout30 during a decrease in the output current Iout30 before the output current Iout30 reaches the lower limit value Imin.

A mid-course stop of decrease in the output current Iout30 and the output voltage Vout30 due to the balancing of such characteristics with each other can be indicated by a point of intersection A1 of a curve representing the foldback type drooping characteristic L1 and a curve representing the voltage-current decrease characteristic L4 or a point of intersection A2 of a curve representing the chevron type drooping characteristic L5 and the curve representing the voltage-current decrease characteristic L4 in FIG. 13. As is clear from FIG. 13, supposing that the same load L30 is connected to the voltage regulator 30 and the power supply circuit, and that the upper limit value Imax and the lower limit value Imin are the same in the foldback type drooping characteristic L1 and the chevron type drooping characteristic L5, since the chevron type drooping characteristic L5 decreases the output current Iout30 substantially linearly, the output current Iout30 and the output voltage Vout30 each stop decreasing at a relatively high value when the chevron type drooping characteristic L5 balances the voltage-current decrease characteristic L4.

On the other hand, since the foldback type drooping characteristic L1 decreases the output current Iout30 exponentially, the output current Iout30 and the output voltage Vout30 each decrease to a lower value than in the case of the chevron type drooping characteristic L5 and stop decreasing when the foldback type drooping characteristic L1 balances the voltage-current decrease characteristic L4. Hence, the voltage regulator 30 lowers the output voltage Vout30 to a very low value together with the output current Iout30 as compared with the power supply circuit such as the direct-current power supply device 15 or the like that limits the output current Iout30 according to the conventional chevron type drooping characteristic L5 at a time of an overload. Thus the voltage regulator 30 can protect the regulator itself and the load L30 at a time of an overload.

When the voltage regulator 30 with the above configuration raises the output voltage Vout30 in response to an input of the enable signal S2, the delay circuit unit 32 delays the enable signal S2 from a point in time of the input of the enable signal S2 by the delay time Tra corresponding to a certain time from a start of charging of the output capacitor C30 to a completion of the charging of the output capacitor C30 when the output capacitor C30 can be normally charged to a specified capacity, as for example when the load L30 is no load, or when a maximum load connected to the voltage regulator 30 is known in advance. The delay circuit unit 32 sets the delayed enable signal S2 as the delayed signal S3, and sends the delayed signal S3 to the mode selector 33. The mode selector 33 in the voltage regulator 30 controls the overcurrent protection circuit unit 34 such that the current limiting characteristic is the constant current type drooping characteristic L3 during a period from the point in time of the input of the enable signal S2 to the voltage regulator 30 to a point in time of input of the delayed signal S3. Also, the mode selector 33 in the voltage regulator 30 controls the overcurrent protection circuit unit 34 such that the current limiting characteristic is changed from the constant current type drooping characteristic L3 to the foldback type drooping characteristic L1 at the point in time of the input of the delayed signal S3.

Thus, the voltage regulator 30 passes the output current Iout30 to the output capacitor C30 while limiting the current value Iout of the output current Iout30 to the upper limit value Imax, which is as high as possible, according to the constant current type drooping characteristic L3 by the mode selector 33 and the overcurrent protection circuit unit 34 during the period from the point in time of the input of the enable signal S2 to the point in time of the input of the delayed signal S3 to the mode selector 33. Thereby, when the load L30 is no load or is connected without being short-circuited or being an overload, the voltage regulator 30 can quickly raise the output voltage Vout30 to the constant voltage value Vct by charging the output capacitor C30 with the output current Iout30 having the upper limit value Imax. In the case of the load L30 being short-circuited or being an overload, when the output current Iout30 is going to flow as an overcurrent even after the point in time of the input of the delayed signal S3 to the mode selector 33 (that is, a point in time of completion of the charging of the output capacitor C30 when the output capacitor C30 can be normally charged to a specified capacity, as for example when the load L30 is no load or is connected without being short-circuited or being an overload, and the point in time of completion of the charging of the output capacitor C30 will be referred to as a normal charging completion expecting time point), the voltage regulator 30 lowers the current value Iout of the output current Iout30 to the lower limit value Imin lower than the upper limit value Imax according to the foldback type drooping characteristic L1 by the overcurrent protection circuit unit 34. Therefore the voltage regulator 30 can surely avoid for example heat generation after the output current Iout30 having the upper limit value Imax flows through the voltage and current controller 31 for a long period of time.

According to the above configuration, in the voltage regulator 30, when the differential amplifier A30 starts operation in response to an input of the enable signal S2 to generate the control signal SV1, and the voltage and current controller 31 generates the output voltage Vout30 by passing the output current Iout30 having the current value Iout according to the control signal SV1 to the output capacitor C30 and thus charging the output capacitor C30, the delay circuit unit 32 delays the enable signal S2 by the certain delay time Tra, and sends the delayed enable signal S2 as the delayed signal S3 to the mode selector 33. The overcurrent protection circuit unit 34 sets the constant current type drooping characteristic L3 as the current limiting characteristic during a period from a point in time of the start of operation of the differential amplifier A30 to a point in time of input of the delayed signal S3 to the mode selector 33, and changes the current limiting characteristic to the foldback type drooping characteristic L1 after the point in time of the input of the delayed signal S3 to the mode selector 33. In the voltage regulator 30, the delay time Tra for the enable signal S2 in the delay circuit unit 32 is a certain time from a start of charging of the output capacitor C30 to a completion of the charging of the output capacitor C30 when there is no load, or when a maximum load is known in advance. Thus, when the load L30 is short-circuited or is an overload, the voltage regulator 30 starts lowering the current value Iout of the output current Iout30 from the upper limit value Imax to the lower limit value Imin at the time point at which completion of the normal charging of the output capacitor C30 is expected at the latest. The voltage regulator 30 can prevent the output current Iout30 limited to the upper limit value Imax, which is relatively high as a limit value, from continuing to flow after the normal charging completion expecting time point. The voltage regulator 30 can therefore minimize a time during which the output current Iout30 having the current value Iout limited to the upper limit value Imax continues flowing. Thus, when the load L30 is short-circuited or is an overload, the voltage regulator 30 can avoid heat generation of the voltage and current controller 31, the load L30 and the like, and protect the regulator itself and the load L30.

In addition, the voltage regulator 30 limits the current value Iout of the output current Iout30 with the current limiting characteristic changed from the constant current type drooping characteristic L3 to the foldback type drooping characteristic L1 after the normal charging completion expecting time point, that is, after a point in time at which completion of rising of the output voltage Vout30 is expected. Therefore, even when the load L30 becomes an overload, and decrease in the current value Iout of the output current Iout30 and the voltage value Vout of the output voltage Vout30 is stopped in mid course as the foldback type drooping characteristic L1 balances the voltage-current decrease characteristic L4 of the load L30 after the normal charging completion expecting time point, the voltage regulator 30 can lower the current value Iout and the voltage value Vout as compared with a case where decrease in the current value Iout of the output current Iout30 and the voltage value Vout of the output voltage Vout30 is similarly stopped in mid course with the chevron type drooping characteristic L5. Thus, even when the load L30 is an overload, the voltage regulator 30 can protect the regulator itself and the load L30.

Further, in the voltage regulator 30, a time of change from the constant current type drooping characteristic L3 to the foldback type drooping characteristic L1 is a time of an end of the certain time from a start of charging of the output capacitor C30 to a completion of the charging of the output capacitor C30 when there is no load, or when a maximum load is known in advance. Thus, by measuring the current value Iout of the output current Iout30 and the voltage value Vout of the output voltage Vout30 in timing appropriately selected in advance from an input of the enable signal S2 in a manufacturing factory or the like, for example, it is possible to test easily for normal performance of an overcurrent protecting function by the constant current type drooping characteristic L3 and the foldback type drooping characteristic L1 on the basis of results of the measurement.

In addition, according to the conventional direct-current power supply device 15 (FIG. 21), circuit elements such as the error amplifier 19 and the like take a certain time to become stable and operable when power is turned on via the switch 16. Since the direct-current power supply device 15 raises an output voltage after the circuit elements become stable and operable, it takes a considerable time to raise the output voltage. On the other hand, since the voltage regulator 30 according to the first embodiment raises the output voltage Vout30 in response to an input of the enable signal S2 after circuit elements are already stable and operable, the voltage regulator 30 can greatly increase the speed of rising of the output voltage Vout30 as compared with the direct-current power supply device 15.

Further, in the conventional direct-current power supply device 15, a circuit part that actually raises the output voltage and the switching circuit that controls switching between the constant current type drooping characteristic and the chevron type drooping characteristic in the circuit part operate separately from each other. It is thus considered that the direct-current power supply device 15 requires complex control to switch between the constant current type drooping characteristic and the chevron type drooping characteristic in substantially accurate timing by the switching circuit. On the other hand, the voltage regulator 30 according to the first embodiment delays the enable signal S2 for starting the operation of the differential amplifier A30 by the delay time Tra corresponding to a certain time from a point in time of an input of the enable signal S2 to a point in time at which completion of normal charging of the output capacitor C30 is expected, sets the delayed enable signal S2 as the delayed signal S3, and uses the delayed signal S3 to switch between the constant current type drooping characteristic L3 and the foldback type drooping characteristic L1. When the differential amplifier A30 in the voltage regulator 30 starts operation at the point in time of the input of the enable signal S2, the output current Iout30 accordingly flows to the output capacitor C30 to start charging the output capacitor C30. Therefore the time point of the input of the enable signal S2 substantially coincides with a time point of a start of the charging of the output capacitor C30. Therefore the voltage regulator 30 can easily and accurately change the constant current type drooping characteristic L3 to the foldback type drooping characteristic L1 at the time point at which completion of normal charging of the output capacitor C30 is expected, with the time point of the input of the enable signal S2 as a starting point. Consequently, the voltage regulator 30 can always accurately change the constant current type drooping characteristic L3 to the foldback type drooping characteristic L1 at the time point at which completion of normal charging of the output capacitor C30 is expected. Thus, when the load L30 is short-circuited or is an overload, it is possible to avoid heat generation of the voltage and current controller 31, the load L30 and the like as a result of the output current Iout30 limited to the upper limit value Imax, which is relatively high as a limit value, continuing to flow after the normal charging completion expecting time point.

It is to be noted that while description in the foregoing first embodiment has been made of a case where the time point at which completion of normal charging of the output capacitor C30 is expected, that is, a time point at which completion of rising of the output voltage Vout30 to the constant voltage value Vct is expected is set as the time of change from the constant current type drooping characteristic L3 to the foldback type drooping characteristic L1, the present invention is not limited to this, and an arbitrary time point before the time point at which completion of rising of the output voltage Vout30 is expected may be set as the time of change from the constant current type drooping characteristic L3 to the foldback type drooping characteristic L1.

When T5 denotes the time of change from the constant current type drooping characteristic L3 to the foldback type drooping characteristic L1 before completion of rising of the output voltage Vout30, a starting time Tr3 of the output voltage Vout30 is longer than the starting times Tr1 and Tr2 represented by the above-described Equation (3) and Equation (4) because the current value Iout of the output current Iout30 is limited to the lower limit value Imin in the course of starting of the output voltage Vout30, as expressed by Equation (5).

[Equation 5] (5)

$$Tr3 = (T5 - T1) + \left\{\frac{(T5 - T1) \times I_{\max}}{Cout}\right\} \times \frac{Cout}{I\ \min}$$

When the value of the term (T5−T1) in Equation (5) is about 80% or more of the starting time Tr1 expressed by Equation (3), for example, the output voltage Vout30 has already risen to a value close to the constant voltage value Vct, and therefore the output voltage Vout30 can rise fully to the constant voltage value Vct with the starting time Tr3 relatively shortened. In the case where a change is made from the constant current type drooping characteristic L3 to the foldback type drooping characteristic L1 in the course of rising of the output voltage Vout30, when the lower limit value Imin is appropriately selected to be higher than the current value Iout of the output current Iout30 flowing through the load L30, even when a change is made from the constant current type drooping characteristic L3 to the foldback type drooping characteristic L1 and the current value Iout of the output current Iout30 is limited to the lower limit value Imin, it is possible to prevent the output current Iout30 limited to the lower limit value Imin from flowing through the load L30 as it is, and prevent incomplete charging of the output capacitor C30 (that is, the output voltage Vout30 not rising to the constant voltage value Vct).

(2) Second Embodiment

Figure 14:
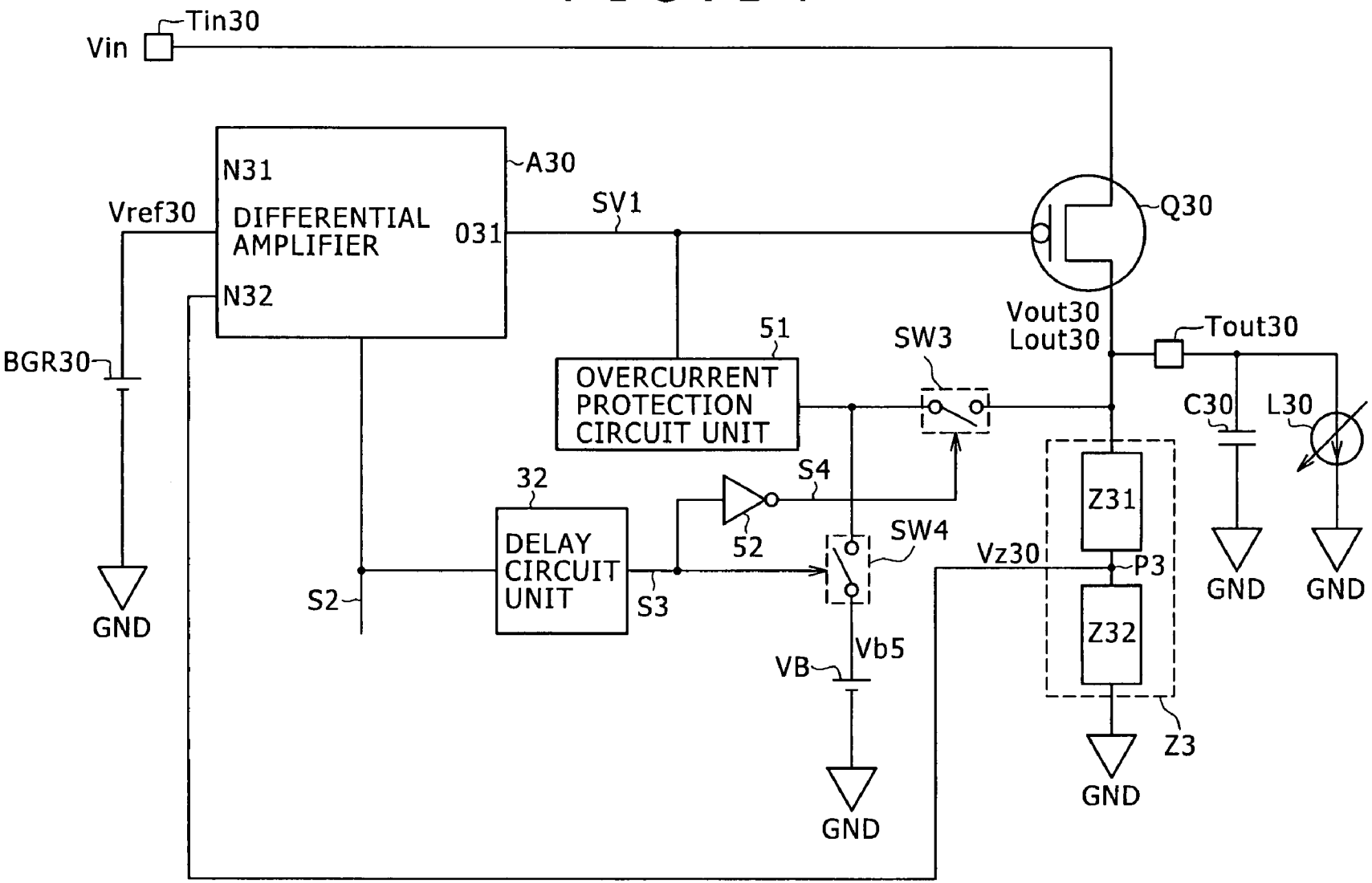
FIG. 14 is a block diagram showing a configuration of a voltage regulator according to a second embodiment.

FIG. 14, in which parts corresponding to those in FIG. 1 are identified by the same reference numerals, shows a voltage regulator 50 according to a second embodiment. An overcurrent protection circuit unit 51 is connected to an intermediate connection point between a differential amplifier A30 and a P-channel MOS type voltage and current controlling transistor Q30, for example, as a voltage and current controller. This overcurrent protection circuit unit 51 is also connected to an output terminal Tout30 via a third selector switch SW3. A fourth selector switch SW4 and a constant-voltage source VB is connected in series with each other between a ground GND and an intermediate connection point between the overcurrent protection circuit unit 51 and the third selector switch SW3. A delay circuit unit 32 is connected with the third selector switch SW3 via an inverter 52, and is directly connected with the fourth selector switch SW4.

In this case, at a time of a start of operation, the voltage regulator 50 opens the contact of the third selector switch SW3 (that is, the voltage regulator 50 disconnects the overcurrent protection circuit unit 51 from the output terminal Tout30), and closes the contact of the fourth selector switch SW4 (that is, there is continuity between the overcurrent protection circuit unit 51 and the constant-voltage source VB). When an enable signal S2 is externally input in this state, the differential amplifier A30 starts operation. The differential amplifier A30 supplies a control signal SV1 to the voltage and current controlling transistor Q30 to control the impedance of the voltage and current controlling transistor Q30. The voltage and current controlling transistor Q30 thereby increases the current value of an output current Iout30 flowing from an input terminal Tin30 to the output terminal Tout30.

At this time, the overcurrent protection circuit unit 51 starts operation in such a manner as to be interlocked with a start of operation of the differential amplifier A30. The overcurrent protection circuit unit 51 at this time sets an upper limit value for a constant current type drooping characteristic on the basis of a constant voltage Vb5 supplied from the constant-voltage source VB via the fourth selector switch SW4. In this state, the overcurrent protection circuit unit 51 appropriately adjusts the value of the control signal SV1 supplied from the differential amplifier A30 to the voltage and current controlling transistor Q30 according to the constant current type drooping characteristic. Thereby, when the current value of the output current Iout30 reaches the upper limit value, the voltage and current controlling transistor Q30 raises an output voltage Vout30 to a constant voltage value while limiting the current value to the upper limit value, so that the voltage and current controlling transistor Q30 prevents an inrush current or an overcurrent from flowing to the output terminal Tout30.

The externally supplied enable signal S2 is input not only to the differential amplifier A30 but also to the delay circuit unit 32. The delay circuit unit 32 delays the enable signal S2 by a certain time from a start of charging of a output capacitor C30 to a completion of the charging of the output capacitor C30 when there is no load, or when a maximum load is known in advance, that is, by a delay time Tra corresponding to the starting time Tr1 or Tr2 of the output voltage Vout30. On arriving at a delay end time point, the delay circuit unit 32 sends the enable signal S2 as a delayed signal S3 to the fourth selector switch SW4, and supplies the third selector switch SW3 with an inverted signal S4 obtained by inverting the logical level of the delayed signal S3 via the inverter 52. Thereby, in response to the input of the inverted signal S4, the third selector switch SW3 closes the contact thereof to thus provide continuity between the overcurrent protection circuit unit 51 and the output terminal Tout30. The fourth selector switch SW4 opens the contact thereof in response to the input of the delayed signal S3 to thereby disconnect the overcurrent protection circuit unit 51 from the constant-voltage source VB.

Therefore, at this time, the overcurrent protection circuit unit 51 is supplied with the output voltage Vout30 and the output current Iout30 from the output terminal Tout30 via the third selector switch SW3 in place of the constant voltage Vb5. At this time, the overcurrent protection circuit unit 51 sets therewithin a lower limit value for a chevron type drooping characteristic. The overcurrent protection circuit unit 51 appropriately adjusts the value of the control signal SV1 supplied from the differential amplifier A30 to the voltage and current controlling transistor Q30 according to the chevron type drooping characteristic while monitoring the output voltage Vout30 and the output current Iout30. Thereby, when the current value of the output current Iout30 has reached the upper limit value, the voltage and current controlling transistor Q30 lowers the current value from the upper limit value to the lower limit value, and also lowers the voltage value of the output voltage Vout30 in synchronism with the lowering of the current value.

Figure 15:
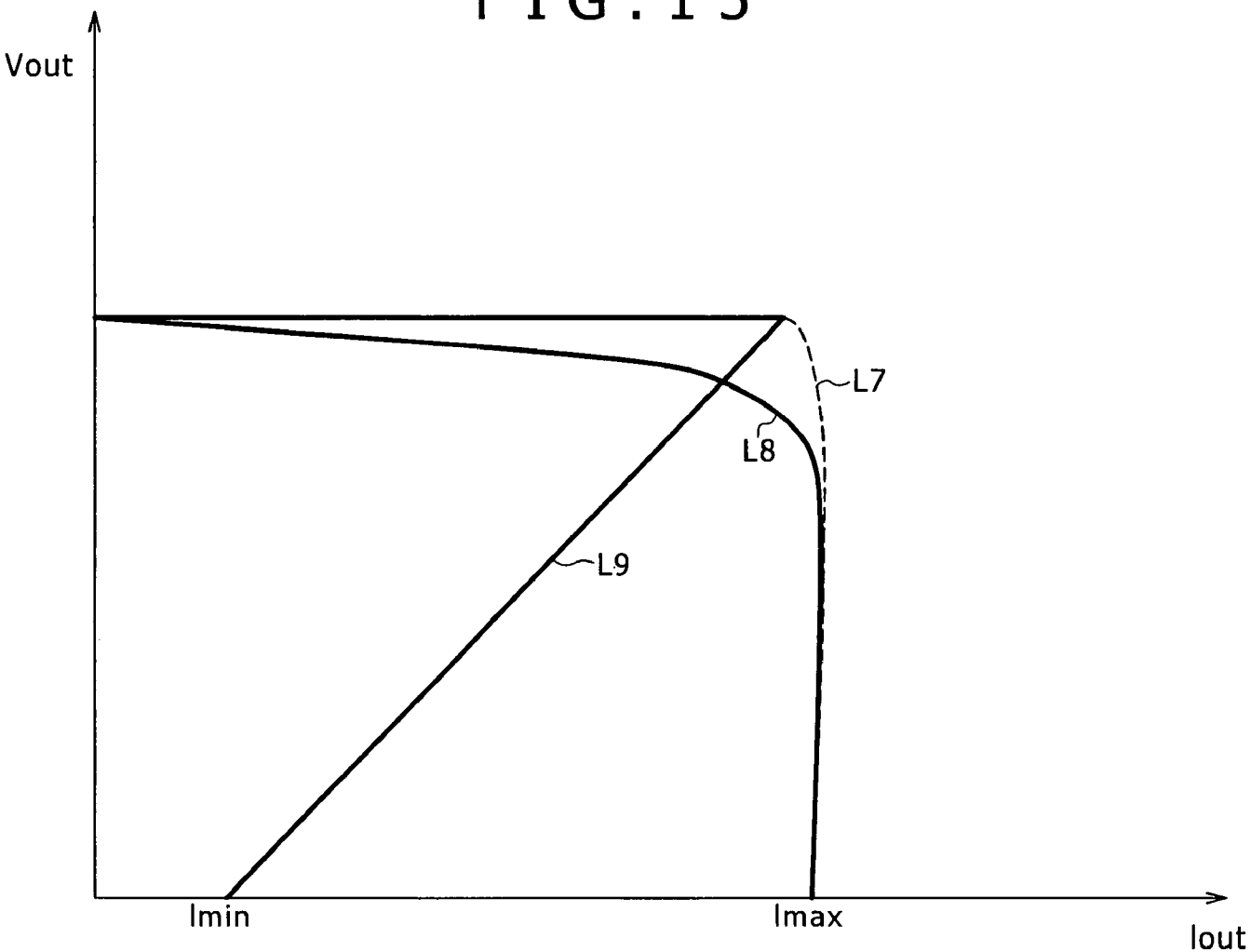
FIG. 15 is a schematic diagram showing a voltage-current characteristic at a time of rising of an output voltage.
Figure 16:
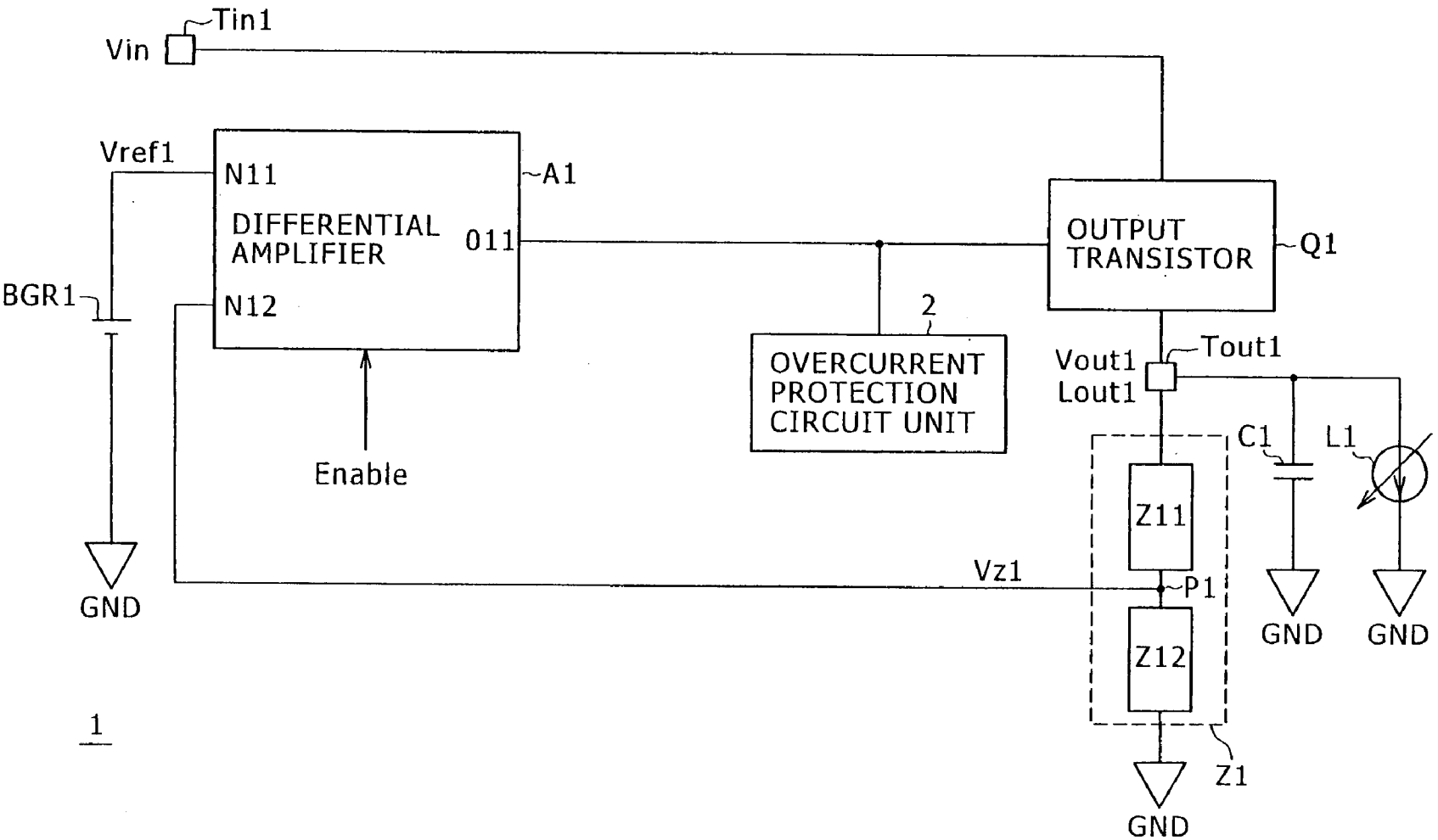
FIG. 16 PRIOR ART
FIG. 16 is a block diagram showing a configuration of a conventional, typical voltage regulator having an overcurrent protection function.
Figure 17:
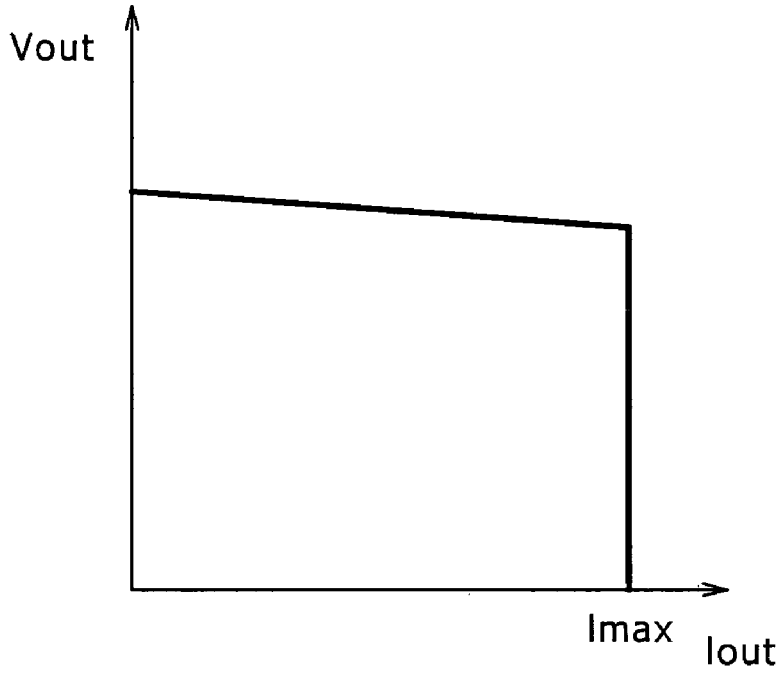
FIG. 17 is a schematic diagram of assistance in explaining a constant current type drooping characteristic.
Figure 18:
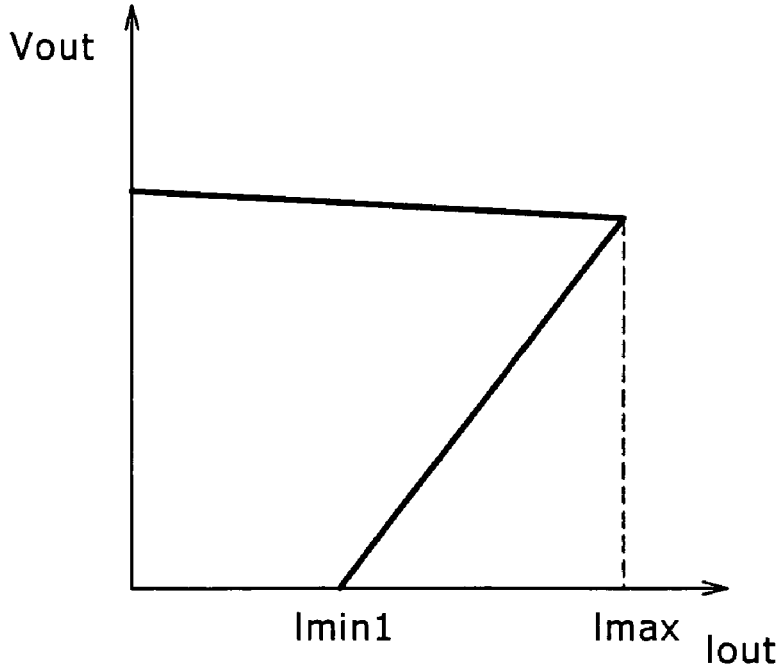
FIG. 18 is a schematic diagram of assistance in explaining a chevron type drooping characteristic.
Figure 19:
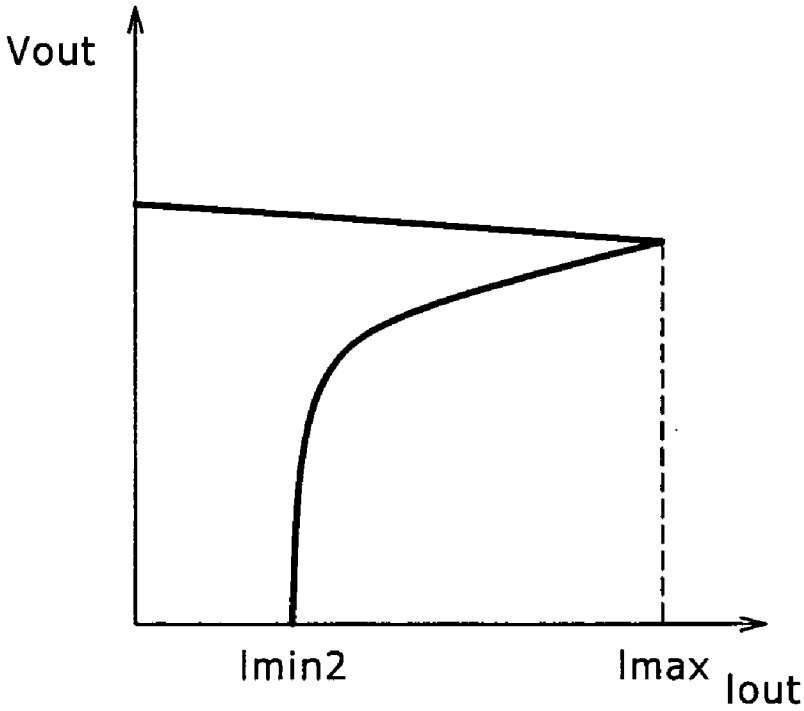
FIG. 19 is a schematic diagram of assistance in explaining a foldback type drooping characteristic.
Figure 20:
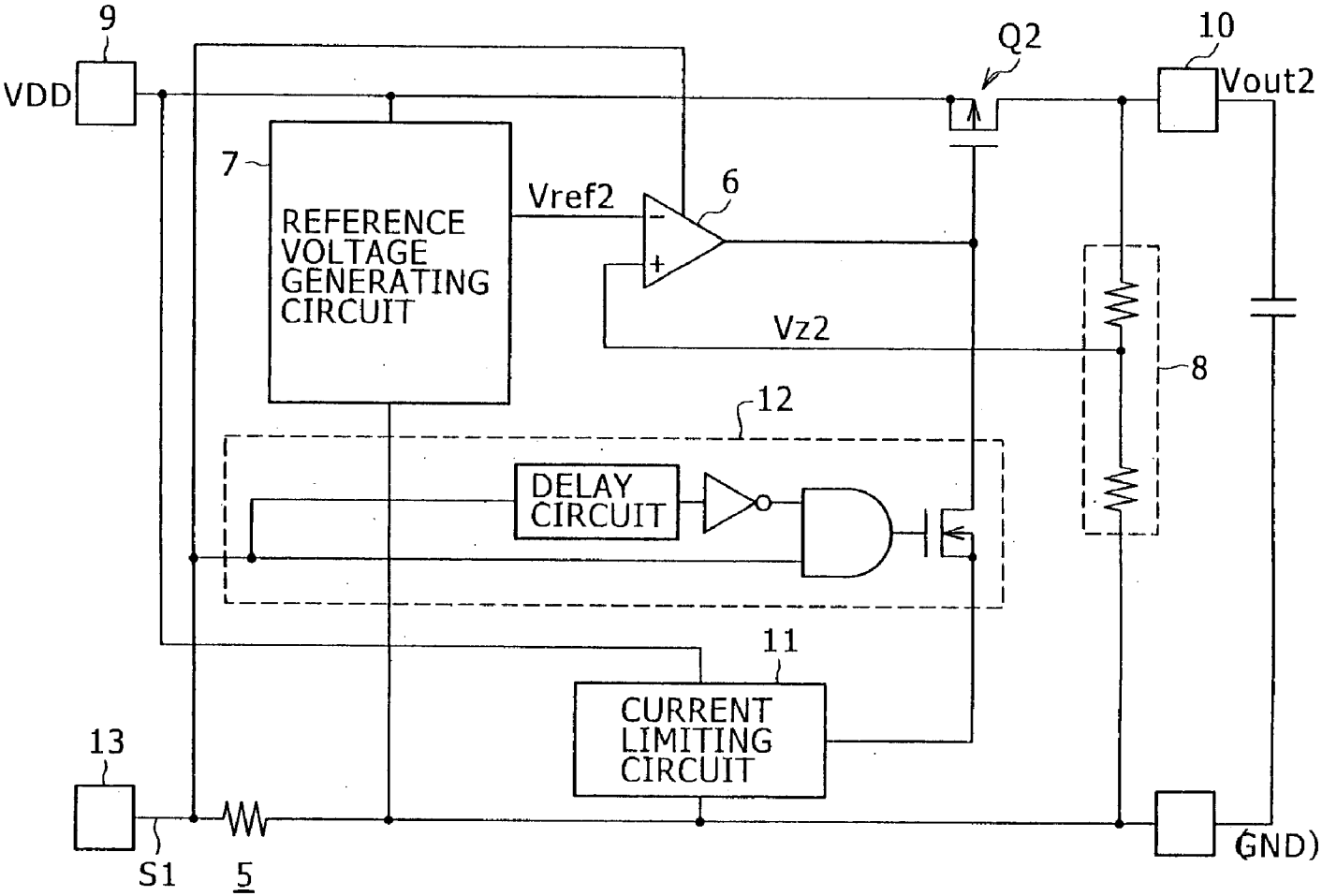
FIG. 20 PRIOR ART
FIG. 20 is a block diagram showing a configuration of a conventional voltage regulator.

Thus, as shown in FIG. 15, the voltage regulator 50 sets the upper limit value Imax of the constant current type drooping characteristic L7 represented partly by a broken line in the overcurrent protection circuit unit 51 on the basis of the constant voltage Vb5 at the time of rising of the output voltage Vout30. In the voltage regulator 50, as the output voltage Vout30 is rising, a difference voltage between a reference voltage Vref30 and a divided voltage Vz30 input to the differential amplifier A30 is decreased, and the output of the differential amplifier A30 is thus changed. Therefore, in the voltage regulator 50, the output voltage Vout30 rises following a locus represented by a solid line L8. After the time point at which the delaying of the enable signal S2 is ended, the voltage regulator 50 lowers the current value of the output current Iout30 from the upper limit value Imax to the lower limit value Imin according to the chevron type drooping characteristic L9, and also lowers the voltage value of the output voltage Vout30 in synchronism with the lowering of the current value.

When the voltage regulator 50 with the above configuration raises the output voltage Vout30 in response to an input of the enable signal S2, the delay circuit unit 32 delays the enable signal S2 from a point in time of the input of the enable signal S2 by the delay time Tra corresponding to a certain time from a start of charging of the output capacitor C30 to a completion of the charging of the output capacitor C30 when the output capacitor C30 can be normally charged to a specified capacity, as for example when a load L30 is no load, or when a maximum load connected to the voltage regulator 50 is known in advance. The delay circuit unit 32 sets the delayed enable signal S2 as the delayed signal S3, and controls the switching of the third selector switch SW3 and the fourth selector switch SW4 by the delayed signal S3. During a period from the point in time of the input of the enable signal S2 to the voltage regulator 50 to the delay end time point, the overcurrent protection circuit unit 51 in the voltage regulator 50 operates according to the constant current type drooping characteristic L7 on the basis of the constant voltage Vb5 supplied from the constant-voltage source VB via the fourth selector switch SW4. After the time point at which the delaying of the enable signal S2 is ended, the overcurrent protection circuit unit 51 in the communication path 50 changes the current limiting characteristic from the constant current type drooping characteristic L7 to the chevron type drooping characteristic L9 on the basis of the output voltage Vout30 and the output current Iout30 supplied from the output terminal Tout30 via the third selector switch SW3 in place of the constant voltage Vb5.

Thus, the voltage regulator 50 passes the output current Iout30 to the output capacitor C30 while limiting the current value Iout of the output current Iout30 to the upper limit value Imax, which is as high as possible, according to the constant current type drooping characteristic L7 by the overcurrent protection circuit unit 51 during the period from the point in time of the input of the enable signal S2 to the delay end time point. Thereby, when the load L30 is no load or is connected without being short-circuited or being an overload, the voltage regulator 50 can quickly raise the output voltage Vout30 to the constant voltage value Vct by charging the output capacitor C30 with the output current Iout30 having the upper limit value Imax. In the case of the load L30 being short-circuited or being an overload, when the output current Iout30 is going to flow as an overcurrent even after the point in time at which the delaying of the enable signal S2 is ended (that is, a normal charging completion expecting time point), the voltage regulator 50 lowers the current value Iout of the output current Iout30 to the lower limit value Imin lower than the upper limit value Imax according to the chevron type drooping characteristic L9 by the overcurrent protection circuit unit 51. Therefore the voltage regulator 50 can surely avoid for example heat generation after the output current Iout30 having the upper limit value Imax flows through the voltage and current controlling transistor Q30 for a long period of time.

According to the above configuration, in the voltage regulator 50, when the differential amplifier A30 starts operation in response to an input of the enable signal S2 to generate the control signal SV1, and the voltage and current controlling transistor Q30 generates the output voltage Vout30 by passing the output current Iout30 having a current value according to the control signal SV1 to the output capacitor C30 and thus charging the output capacitor C30, the delay circuit unit 32 delays the enable signal S2 by the certain delay time Tra, and controls the switching of the third selector switch SW3 and the fourth selector switch SW4. The overcurrent protection circuit unit 51 sets the constant current type drooping characteristic L7 as the current limiting characteristic during a period from a point in time of the start of operation of the differential amplifier A30 to a point in time at which the third selector switch SW3 and the fourth selector switch SW4 are controlled to be switched (that is, the normal charging completion expecting time point), and changes the current limiting characteristic from the constant current type drooping characteristic L7 to the chevron type drooping characteristic L9 after the point in time at which the third selector switch SW3 and the fourth selector switch SW4 are controlled to be switched. In the voltage regulator 50, the delay time Tra for the enable signal S2 in the delay circuit unit 32 is a certain time from a start of charging of the output capacitor C30 to a completion of the charging of the output capacitor C30 when there is no load, or when a maximum load is known in advance. Thus, when the load L30 is short-circuited or is an overload, the voltage regulator 50 changes the constant current type drooping characteristic L7 to the chevron type drooping characteristic L9 at the time point at which completion of the normal charging of the output capacitor C30 is expected at the latest. The voltage regulator 50 can therefore prevent the output current Iout30 limited to the upper limit value Imax, which is relatively high as a limit value, from continuing to flow after the normal charging completion expecting time point. Thus, the voltage regulator 50 according to the second embodiment can provide similar effects to those of the foregoing first embodiment.

Further, in the voltage regulator 50, a time of change from the constant current type drooping characteristic L7 to the chevron type drooping characteristic L9 is a time of an end of the certain time from a start of charging of the output capacitor C30 to a completion of the charging of the output capacitor C30 when there is no load, or when a maximum load is known in advance. Thus, by measuring the current value of the output current Iout30 and the voltage value of the output voltage Vout30 in timing appropriately selected in advance from an input of the enable signal S2 in a manufacturing factory or the like, for example, it is possible to test easily for normal performance of an overcurrent protecting function by the constant current type drooping characteristic L7 and the chevron type drooping characteristic L9 on the basis of results of the measurement.

In addition, according to the conventional direct-current power supply device 15 (FIG. 21), circuit elements such as the error amplifier 19 and the like take a certain time to become stable and operable when power is turned on via the switch 16. Since the direct-current power supply device 15 raises an output voltage after the circuit elements become stable and operable, it takes a considerable time to raise the output voltage. On the other hand, as with the voltage regulator 30 according to the foregoing first embodiment, the voltage regulator 50 according to the second embodiment can greatly increase the speed of rising of the output voltage Vout30 as compared with the direct-current power supply device 15.

Further, in the conventional direct-current power supply device 15, a circuit part that actually raises the output voltage and the switching circuit that controls switching between the constant current type drooping characteristic and the chevron type drooping characteristic in the circuit part operate separately from each other. It is thus considered that the direct-current power supply device 15 requires complex control to switch between the constant current type drooping characteristic and the chevron type drooping characteristic in substantially accurate timing by the switching circuit. On the other hand, the voltage regulator 50 according to the second embodiment delays the enable signal S2 for starting the operation of the differential amplifier A30 by the delay time Tra corresponding to a certain time from a point in time of an input of the enable signal S2 to a point in time at which completion of normal charging of the output capacitor C30 is expected, sets the delayed enable signal S2 as the delayed signal S3, and uses the delayed signal S3 to switch between the constant current type drooping characteristic L7 and the chevron type drooping characteristic L9. When the differential amplifier A30 in the voltage regulator 50 starts operation at the point in time of the input of the enable signal S2, the output current Iout30 accordingly flows to the output capacitor C30 to start charging the output capacitor C30. Therefore the time point of the input of the enable signal S2 substantially coincides with a time point of a start of the charging of the output capacitor C30. Therefore the voltage regulator 50 can easily and accurately change the constant current type drooping characteristic L7 to the chevron type drooping characteristic L9 at the time point at which completion of normal charging of the output capacitor C30 is expected, with the time point of the input of the enable signal S2 as a starting point. Consequently, the voltage regulator 50 can always accurately change the constant current type drooping characteristic L7 to the chevron type drooping characteristic L9 at the time point at which completion of normal charging of the output capacitor C30 is expected. Thus, when the load L30 is short-circuited or is an overload, it is possible to avoid heat generation of the voltage and current controlling transistor Q30, the load L30 and the like as a result of the output current Iout30 limited to the upper limit value Imax, which is relatively high as a limit value, continuing to flow after the normal charging completion expecting time point.

It is to be noted that while description in the foregoing second embodiment has been made of a case where the time point at which completion of normal charging of the output capacitor C30 is expected, that is, a time point at which completion of rising of the output voltage Vout30 to the constant voltage value is expected is set as the time of change from the constant current type drooping characteristic L7 to the chevron type drooping characteristic L9, the present invention is not limited to this, and an arbitrary time point before the time point at which completion of rising of the output voltage Vout30 is expected may be set as the time of change from the constant current type drooping characteristic L7 to the chevron type drooping characteristic L9.

(3) Other Embodiments

It is to be noted that while description in the foregoing first and second embodiments has been made of a case where a voltage regulator according to the present invention is applied to the voltage regulators 30 and 50 described above with reference to FIGS. 1 to 15, the present invention is not limited to this, and is applicable to voltage regulators that can arbitrarily select the constant voltage value of the output voltage Vout30.

In addition, while description in the foregoing first and second embodiments has been made of a case where the differential amplifier A30 described above with reference to FIGS. 1 to 15 is applied as control signal generating means for starting operation in response to an enable signal and generating a control signal for generating an output voltage, the present invention is not limited to this, and control signal generating means of various other configurations are widely applicable as long as the control signal generating means can start operation in response to an enable signal and generate a control signal for generating an output voltage.

Further, while description in the foregoing first and second embodiments has been made of a case where the voltage and current controller 31 formed by a P-channel MOS type voltage and current controlling transistor and the voltage and current controlling transistor Q30 described above with reference to FIGS. 1 to 15 are applied as output controlling means for generating the output voltage by charging an output capacitor while controlling a current value of an output current flowing to the output capacitor according to the control signal generated by the signal generating means, the present invention is not limited to this, and various other output controlling means such as N-channel MOS type transistors and the like are widely applicable.

Further, while description in the foregoing embodiments has been made of a case where the mode selector 33 and the overcurrent protection circuit unit 34, and the overcurrent protection circuit unit 51, the inverter 52, the third selector switch SW3, the fourth selector switch SW4, and the constant-voltage source VB described above with reference to FIGS. 1 to 15 are applied as current limiting means for limiting the current value of the output current by a constant current type drooping characteristic that limits the current value of the output current to a first limit value and holds the current value of the output current constant by adjusting a value of the control signal when the current value of the output current reaches the first limit value, and a current limiting characteristic that limits the current value of the output current to a second limit value lower than the first limit value by adjusting the value of the control signal when the current value of the output current reaches the first limit value, the present invention is not limited to this, and various other current limiting means, such for example as a current limiting circuit unit into which the mode selector 33 and the overcurrent protection circuit unit 34 are integrated, are widely applicable.

The present invention is applicable to voltage regulators provided in various devices such as portable telephones, PDAs and the like.

It should be understood by those skilled in the art that various modifications, combinations, sub-combinations and alterations may occur depending on design requirements and other factors insofar as they are within the scope of the appended claims or the equivalents thereof.

What is claimed is:

1. A voltage regulator comprising:

control signal generating means for starting operation in response to an enable signal and generating a control signal for generating an output voltage;

output controlling means for generating said output voltage by charging an output capacitor while controlling a current value of an output current flowing to said output capacitor according to said control signal generated by said control signal generating means;

current limiting means for limiting the current value of said output current by a constant current type drooping characteristic that limits the current value of said output current to a first limit value and holds the current value of said output current constant by adjusting a value of said control signal when the current value of said output current reaches said first limit value, and a current limiting characteristic that limits the current value of said output current to a second limit value lower than said first limit value by adjusting the value of said control signal when the current value of said output current reaches said first limit value; and delaying means supplied with said enable signal together with said control signal generating means, for delaying the input said enable signal by a delay time or less, the delay time corresponding to a certain time from a start of charging of said output capacitor to a completion of the charging of said output capacitor when said output capacitor can be normally charged to a specified capacity, and sending the delayed said enable signal as a delayed signal to said current limiting means;

wherein said current limiting means operates according to said constant current type drooping characteristic during a period from a point in time of a start of operation of said control signal generating means to a point in time of input of said delayed signal, and operates according to said current limiting characteristic after said point in time of the input of said delayed signal.

2. The voltage regulator as claimed in claim 1, wherein said delaying means delays said enable signal by said delay time between about 80% of said certain time and said certain time, and sends the delayed said enable signal as said delayed signal to said current limiting means.

3. The voltage regulator as claimed in claim 1, wherein after said point in time of the input of said delayed signal, said current limiting means operates according to a foldback type drooping characteristic as said current limiting characteristic, said foldback type drooping characteristic exponentially lowering the current value of said output current from said first limit value and limiting the current value of said output current to said second limit value by adjusting the value of said control signal when the current value of said output current reaches said first limit value.

4. A voltage regulator comprising:

a control signal generator starting operation in response to an enable signal and generating a control signal for generating an output voltage;

an output controller generating said output voltage by charging an output capacitor while controlling a current value of an output current flowing to said output capacitor according to said control signal generated by said control signal generator;

a current limiter limiting the current value of said output current by a constant current type drooping characteristic that limits the current value of said output current to a first limit value and holds the current value of said output current constant by adjusting a value of said control signal when the current value of said output current reaches said first limit value, and a current limiting characteristic that limits the current value of said output current to a second limit value lower than said first limit value by adjusting the value of said control signal when the current value of said output current reaches said first limit value; and a delayer supplied with said enable signal together with said control signal generator, said delayer delaying the input said enable signal by a delay time or less, the delay time corresponding to a certain time from a start of charging of said output capacitor to a completion of the charging of said output capacitor when said output capacitor can be normally charged to a specified capacity, and sending the delayed said enable signal as a delayed signal to said current limiter;

wherein said current limiter operates according to said constant current type drooping characteristic during a period from a point in time of a start of operation of said control signal generator to a point in time of input of said delayed signal, and operates according to said current limiting characteristic after said point in time of the input of said delayed signal.

* * * * *